US011592771B2

(12) United States Patent
Sakaguchi et al.

(10) Patent No.: US 11,592,771 B2
(45) Date of Patent: Feb. 28, 2023

(54) IMAGE FORMING APPARATUS

(71) Applicant: BROTHER KOGYO KABUSHIKI KAISHA, Nagoya (JP)

(72) Inventors: Shintaro Sakaguchi, Nagoya (JP); Yusuke Ikegami, Nagoya (JP); Yasuhiro Suzuki, Nagoya (JP); Saya Minoshima, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/574,769

(22) Filed: Jan. 13, 2022

(65) Prior Publication Data

US 2022/0221815 A1 Jul. 14, 2022

(30) Foreign Application Priority Data

Jan. 14, 2021 (JP) ..... JP2021-003880

(51) Int. Cl.
*G03G 15/00* (2006.01)
*G03G 15/01* (2006.01)
*G03G 15/23* (2006.01)

(52) U.S. Cl.
CPC ..... *G03G 15/50* (2013.01); *G03G 15/0178* (2013.01); *G03G 15/234* (2013.01); *G03G 15/6579* (2013.01); *G03G 2215/00021* (2013.01); *G03G 2215/00586* (2013.01)

(58) Field of Classification Search
CPC .. G03G 15/50; G03G 15/0178; G03G 15/234; G03G 15/6579; G03G 2215/00021; G03G 2215/00586
See application file for complete search history.

(56) References Cited

U.S. PATENT DOCUMENTS 5,557,367 A * 9/1996 Yang ..... G03G 15/234 399/14
2010/0310268 A1* 12/2010 Obata ..... G03G 15/6508 399/85
2014/0079427 A1 3/2014 Campbell et al.
2015/0363677 A1 12/2015 Nihei
2020/0277155 A1 9/2020 Sano et al.
2021/0294258 A1* 9/2021 Suzuki ..... B65H 5/062

FOREIGN PATENT DOCUMENTS

JP 2002370428 A * 12/2002 ..... B41J 3/546
JP 2016-21048 A 2/2016
JP 2020-140114 A 9/2020

* cited by examiner

*Primary Examiner* — Ryan D Walsh
(74) *Attorney, Agent, or Firm* — Merchant & Gould P.C.

(57) ABSTRACT

A controller is configured to control a print engine and a conveyor to form an image on both sides of a sheet. The controller is configured to: in a case where images to be formed on both sides of each of an Nth (N is a positive integer) sheet, an (N+1)th sheet, and an (N+2)th sheet are all monochrome image or all color image, convey the (N+2)th sheet to the print engine and form an image before forming an image on both sides of the (N+1)th sheet; and in a case where the images to be formed on both sides of each of the Nth sheet, the (N+1)th sheet, and the (N+2)th sheet are a mixture of the monochrome image and the color image, convey the (N+2)th sheet to the print engine and form an image after forming an image on both sides of the (N+1)th sheet.

11 Claims, 12 Drawing Sheets

IMAGE FORMING APPARATUS

CROSS REFERENCE TO RELATED APPLICATIONS

This application claims priority from Japanese Patent Application No. 2021-003880 filed Jan. 14, 2021. The entire content of the priority application is incorporated herein by reference.

BACKGROUND

An image forming apparatus includes an image forming unit (print engine), a conveyor, and a controller. The image forming unit includes a plurality of sets of a development roller and a photosensitive drum, and form an image on a sheet. The conveyor conveys a sheet to the image forming unit and then reverse the sheet and reconveys the sheet to the image forming unit. The controller controls the image forming unit and the conveyor to form images on both sides of the conveyed sheet.

SUMMARY

According to one aspect, this specification discloses an image forming apparatus. The image forming apparatus includes a print engine, a conveyor, and a controller. The print engine includes a plurality of sets of a development roller and a photosensitive drum configured to contact and separate from the development roller. The print engine is configured to form an image on a sheet. The print engine is configured to switch between: a first state in which one of the plurality of sets of the development roller and the photosensitive drum contact each other and an other one of the plurality of sets of the development roller and the photosensitive drum separate from each other for forming a monochrome image; and a second state in which all of the plurality of sets of the development roller and the photosensitive drum contact each other for forming a color image. The conveyor is configured to convey the sheet to the print engine and thereafter reverse a conveyance direction of the sheet and reconvey the sheet to the print engine. The controller is configured to control the print engine and the conveyor to form an image on both sides of the sheet. The controller is configured to: in a case where images to be formed on both sides of each of an Nth (N is a positive integer) sheet, an (N+1)th sheet, and an (N+2)th sheet are all the monochrome image or all the color image, convey the (N+2)th sheet to the print engine and form an image before forming an image on both sides of the (N+1)th sheet; and in a case where the images to be formed on both sides of each of the Nth sheet, the (N+1)th sheet, and the (N+2)th sheet are a mixture of the monochrome image and the color image, convey the (N+2)th sheet to the print engine and form an image after forming an image on both sides of the (N+1)th sheet.

According to another aspect, this specification also discloses an image forming apparatus. The image forming apparatus includes a print engine, a plurality of rollers, and a controller. The print engine includes a plurality of sets of a development roller and a photosensitive drum. The print engine is configured to form an image on a sheet. The plurality of rollers is configured to convey the sheet to the print engine and thereafter reverse a conveyance direction of the sheet and reconvey the sheet to the print engine. The controller is configured to control the print engine and the plurality of rollers to form an image on both sides of the sheet. The controller is configured to: in a case where images to be formed on both sides of each of an Nth (N is a positive integer) sheet, an (N+1)th sheet, and an (N+2)th sheet are all a monochrome image or all a color image, convey the (N+2)th sheet to the print engine and form an image before forming an image on both sides of the (N+1)th sheet; and in a case where the images to be formed on both sides of each of the Nth sheet, the (N+1)th sheet, and the (N+2)th sheet are a mixture of the monochrome image and the color image, convey the (N+2)th sheet to the print engine and form an image after forming an image on both sides of the (N+1)th sheet.

According to the above configuration, in a case where the images formed on both sides of the Nth (N is a positive integer) sheet, the (N+1)th sheet, and the (N+2)th sheet are all monochrome or all colors, the controller of the image forming apparatus of this disclosure conveys the (N+2)th sheet to the print engine and forms an image before forming an image on both sides of the (N+1)th sheet. In this case, three or more sheets are simultaneously conveyed inside the image forming apparatus, and the first state or the second state is switched depending on whether the images are all monochrome or all color.

In a case where the images formed on both sides of the Nth sheet, the (N+1)th sheet, and the (N+2)th sheet are a mixture of monochrome and color, the controller conveys the (N+2)th sheet to the print engine and forms an image after forming an image on both sides of the (N+1)th sheet. In this case, two or less sheets are simultaneously conveyed inside the image forming apparatus, and depending on whether the image is monochrome or color, the state is switched between the first state and the second state each time.

That is, the image forming apparatus selects the timing of conveying the (N+2)th sheet between after forming images on both sides of the (N+1)th sheet or before forming images on both sides of the (N+1)th sheet, thereby changing the page order of images formed by the print engine and switching between the first state and the second state. Specifically, in this image forming apparatus, as the page order for image formation after "page 2, page 4", the page order "page 6, page 1" or "page 1, page 6" or "page 1, page 3" is selectively used.

As a result, the image forming apparatus does not need to form images in the second state from the beginning to the end regardless of whether images are monochrome or color for prioritizing the improvement of the number of sheets processed per unit time, or does not need to convey two or less sheets simultaneously inside the image forming apparatus from the beginning to the end and switch between the first state and the second state depending on whether the image is monochrome or color for prioritizing extending the life of the development roller.

Thus, the image forming apparatus of this disclosure improves the number of sheets processed per unit time and extends the life of the development roller when forming images on both sides of sheets.

BRIEF DESCRIPTION OF THE DRAWINGS

Embodiments in accordance with this disclosure will be described in detail with reference to the following figures wherein:

FIG. 5A is a diagram showing the first state and FIG. 5B is a diagram showing the second state;

and

Figure 12:
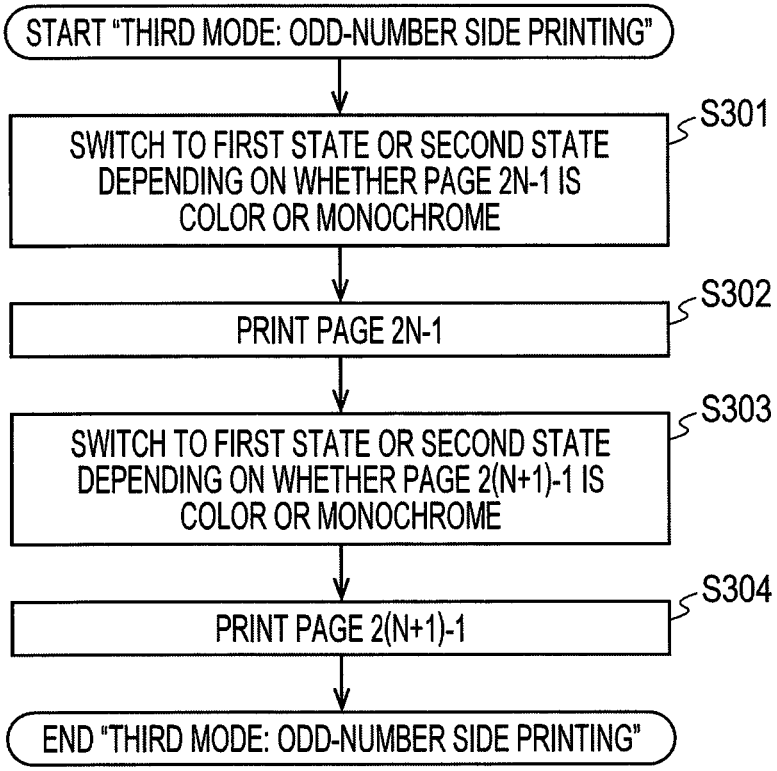

FIG. 12 is a flowchart of a "third mode: odd-number side printing" subroutine.

DETAILED DESCRIPTION

The controller controls the conveyor to convey three or more sheets simultaneously inside the image forming apparatus. Thus, when forming an image on both sides of sheets, the controller executes so-called "2413" control, "2461 control", or "2416 control".

The "2413" control, the "2461 control", and the "2416 control" represent the order of sheet conveyance and the order of image formation when the image forming apparatus forms images on both sides of a plurality of consecutive sheets. In the "2461 control" or the "2416 control", the number of sheets processed per unit time is larger than that of the "2413" control.

As an example, a case where the image forming apparatus executes the "2413" control, the "2461 control" or the "2416 control" based on the following image formation data will be briefly described. In this case, the image formation data is as follows: the first side of the first sheet is page 1, the second side opposite the first side of the first sheet is page 2, the first side of the second sheet is page 3, the second side opposite the first side of the second sheet is page 4, the first side of the third sheet is page 5, the second side opposite the first side of the third sheet is page 6, the first side of the fourth sheet is page 7, and the second side opposite the first side of the fourth sheet is page 8.

When the image forming apparatus executes the "2413" control based on the above image forming data, the controller controls the image forming unit and the conveyor to form images in the order of page 2 on the second side of the first sheet, page 4 on the second side of the second sheet, page 1 on the first side of the first sheet, page 3 on the first side of the second sheet, page 6 on the second side of the third sheet, and so on. At this time, the controller controls the conveyor to simultaneously convey two sheets inside the image forming apparatus.

When the image forming apparatus executes the "2461" control based on the above image forming data, the controller controls the image forming unit and the conveyor to form images in the order of page 2 on the second side of the first sheet, page 4 on the second side of the second sheet, page 6 on the second side of the third sheet, page 1 on the first side of the first sheet, page 8 on the second side of the fourth sheet, page 3 on the first side of the second sheet, and so on. At this time, the controller controls the conveyor to simultaneously convey four or more sheets inside the image forming apparatus.

When the image forming apparatus executes the "2416" control based on the above image forming data, the controller controls the image forming unit and the conveyor to form images in the order of page 2 on the second side of the first sheet, page 4 on the second side of the second sheet, page 1 on the first side of the first sheet, page 6 on the second side of the third sheet, page 3 on the first side of the second sheet, page 8 on the second side of the fourth sheet, and so on. At this time, the controller controls the conveyor to simultaneously convey three sheets inside the image forming apparatus.

In such an image forming apparatus, the photosensitive drum and the development roller are configured to contact and separate from each other in each of the plurality of sets. Further, the image forming unit is switched between: a first state in which one set of the development roller and the photosensitive drum contact each other while the other sets of the development rollers and the photosensitive drums separate from each other in order to form a monochrome image; and a second state in which all sets of the development rollers and the photosensitive drums contact each other in order to form a color image. This reduces the operating time of the development rollers for forming a color image and extends the life of the development rollers.

When an image is formed on both sides of a sheet in the above image forming apparatus, if the state is switched between the first state and the second state while three or more sheets are simultaneously conveyed inside the image forming apparatus, the interval between the sheets that are conveyed simultaneously is short and it is difficult to change the interval to be longer. Thus, it is difficult to secure the time required for the switching operation and the time for suppressing defects such as fogging (a phenomenon that toner on a development roller gets on an unexposed part of a photosensitive drum) after the switching operation.

Thus, for example, if the image is formed in the second state from the beginning to the end regardless of whether the image is monochrome or color by giving priority to improving the number of sheets processed per unit time, it is difficult to extend the life of the development roller.

Further, if two or less sheets are simultaneously conveyed inside the image forming apparatus from the beginning to the end and the state is switched to the first state or the second state depending on whether the image is monochrome or color by giving priority to extending the life of the development roller, it is difficult to increase the number of sheets processed per unit time.

In view of the foregoing, an aspect of an object of this disclosure is to provide an image forming apparatus that, when an image is formed on both sides of sheets, increases the number of sheets processed per unit time and extend the life of the development roller.

Hereinafter, an aspect of this disclosure will be described with reference to the drawings.

As shown in FIGS. 1 to 4, an image forming apparatus 1 (1A, 1B) is an example of the image forming apparatus of this disclosure. The image forming apparatus 1 (1A, 1B) is a laser printer that forms an image on a sheet SH by an electrophotographic method.

Figure 1:
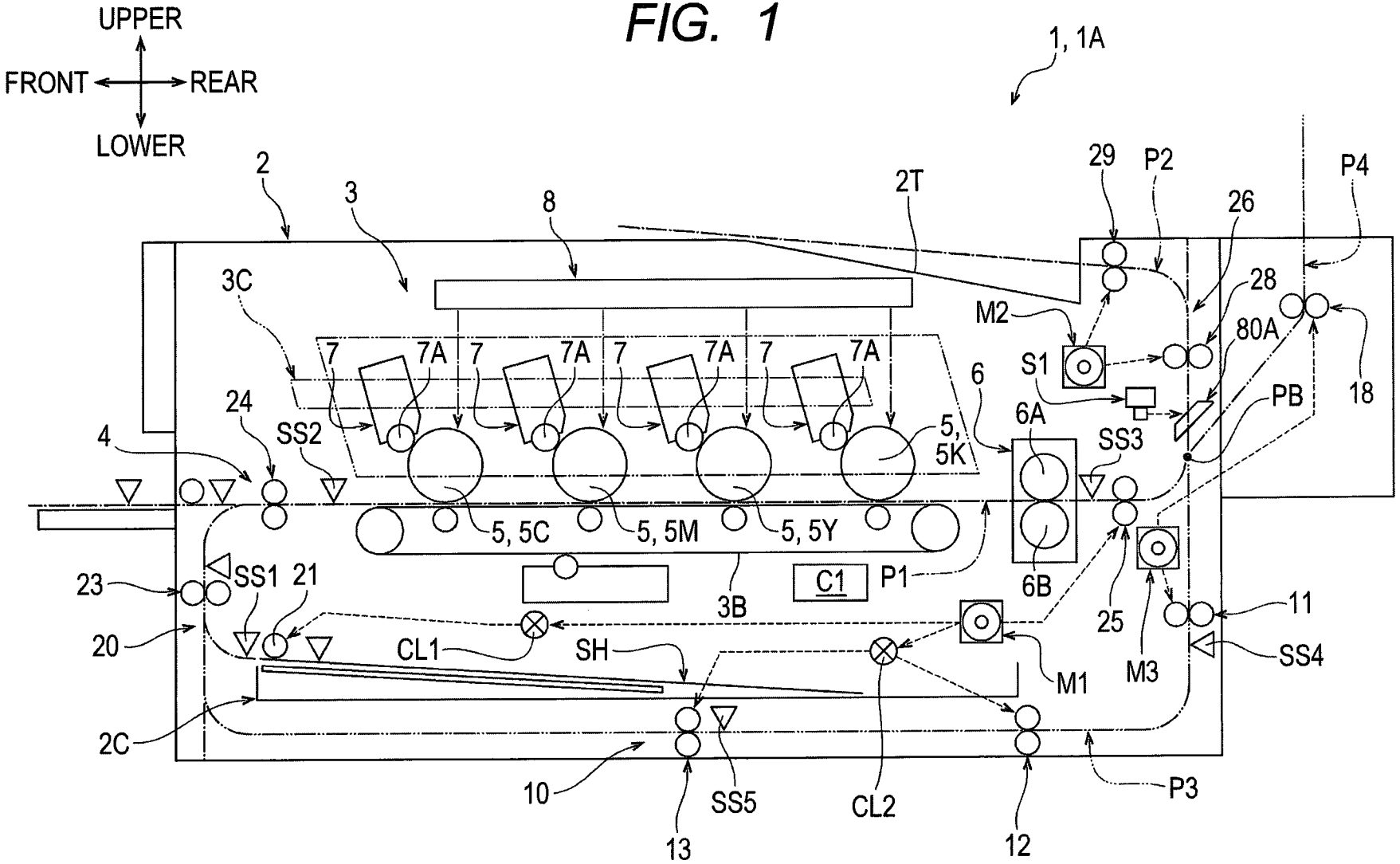
FIG. 1 is a schematic cross-sectional view showing an image forming apparatus of a "2461" model.
Figure 2:
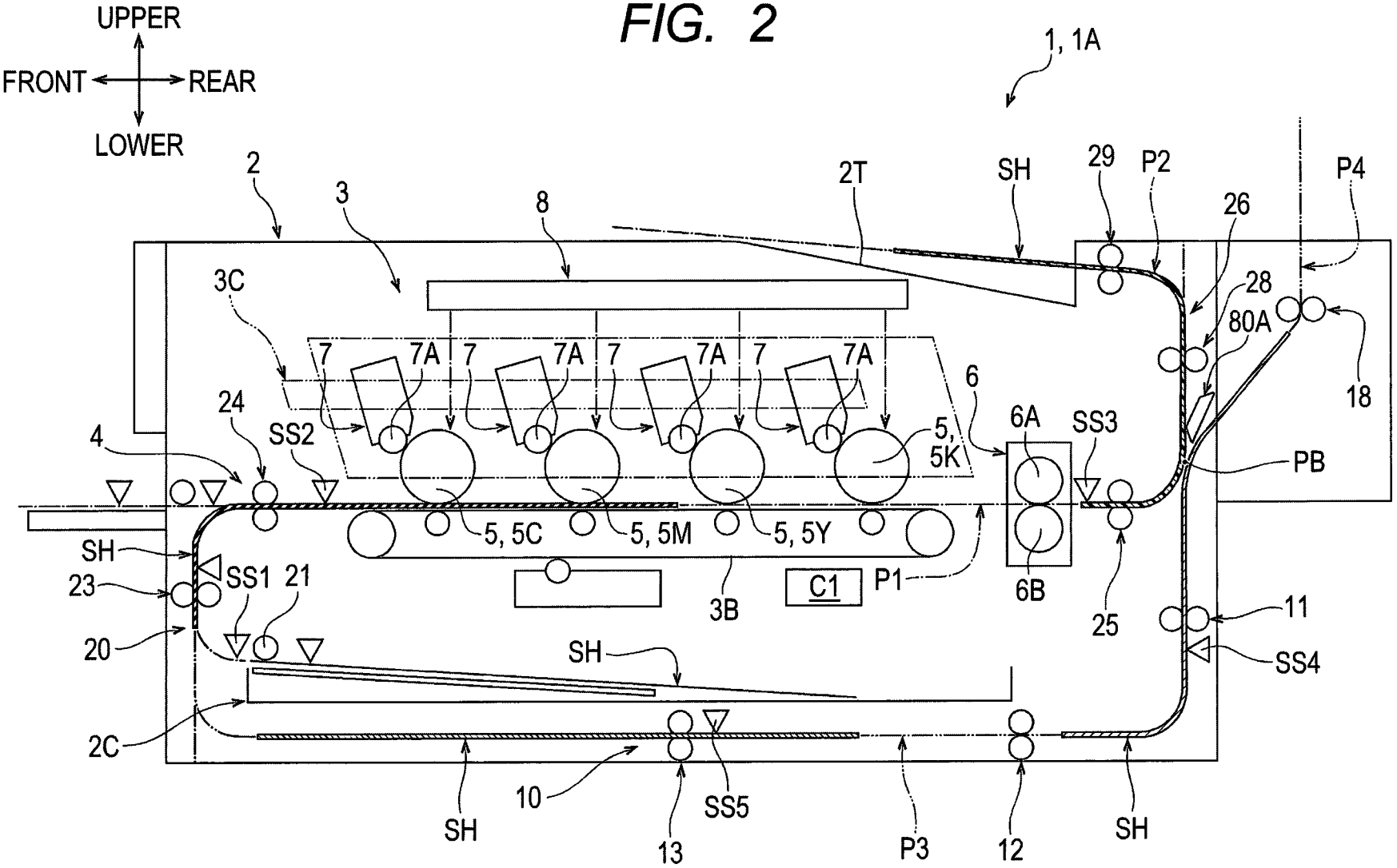
FIG. 2 is a schematic cross-sectional view similar to FIG. 1, showing a state in which four or more sheets are simultaneously conveyed inside an apparatus main body.

The image forming apparatus 1 (1A) shown in FIGS. 1 and 2 is a "2461" model (an example of first conveyance type) capable of executing "2461" control. As shown in FIG. 2, the image forming apparatus 1 (1A) is configured to simultaneously convey four or more sheets SH inside an apparatus main body 2.

Figure 3:
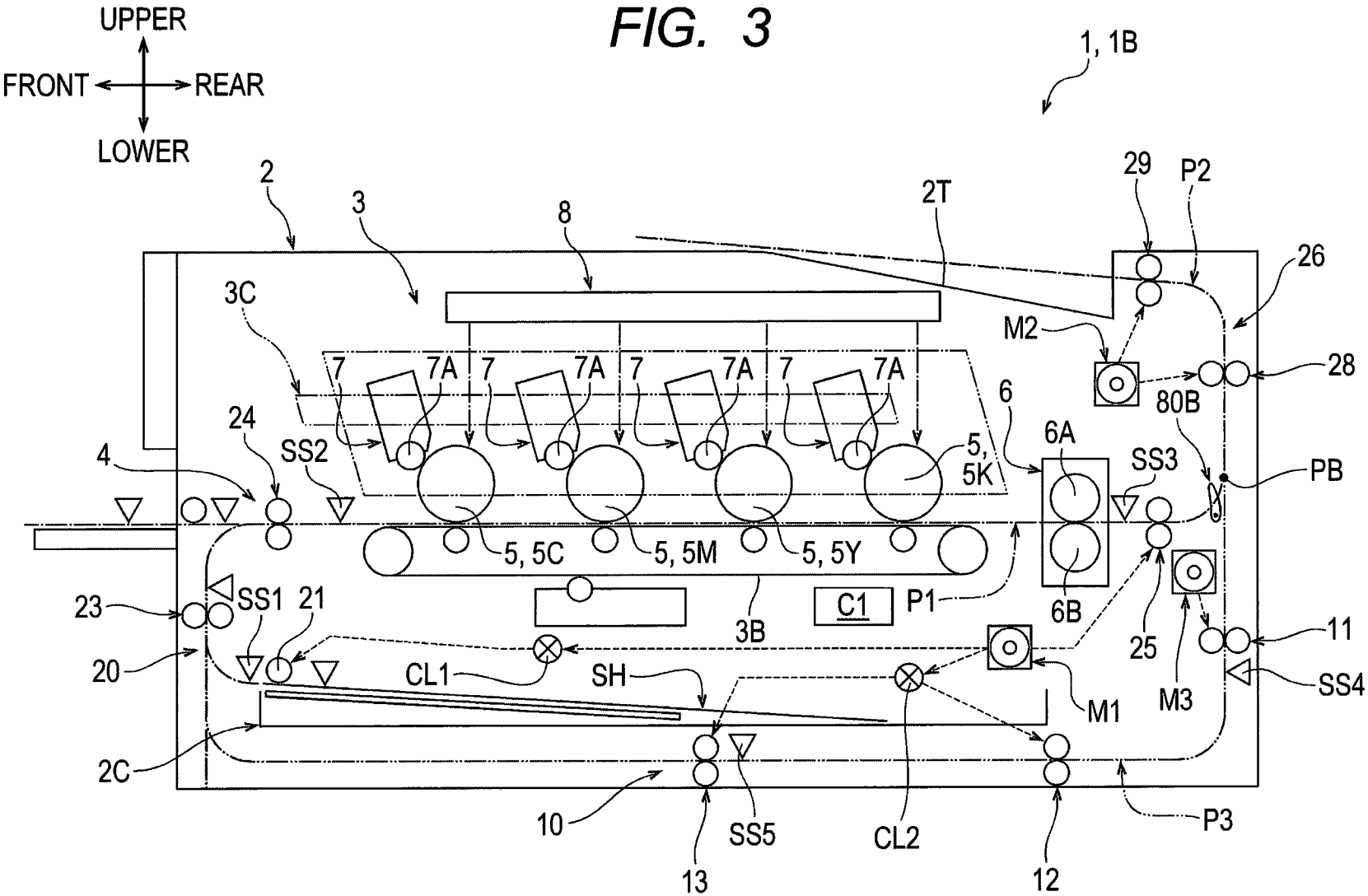
FIG. 3 is a schematic cross-sectional view showing an image forming apparatus of a "2416" model.
Figure 4:
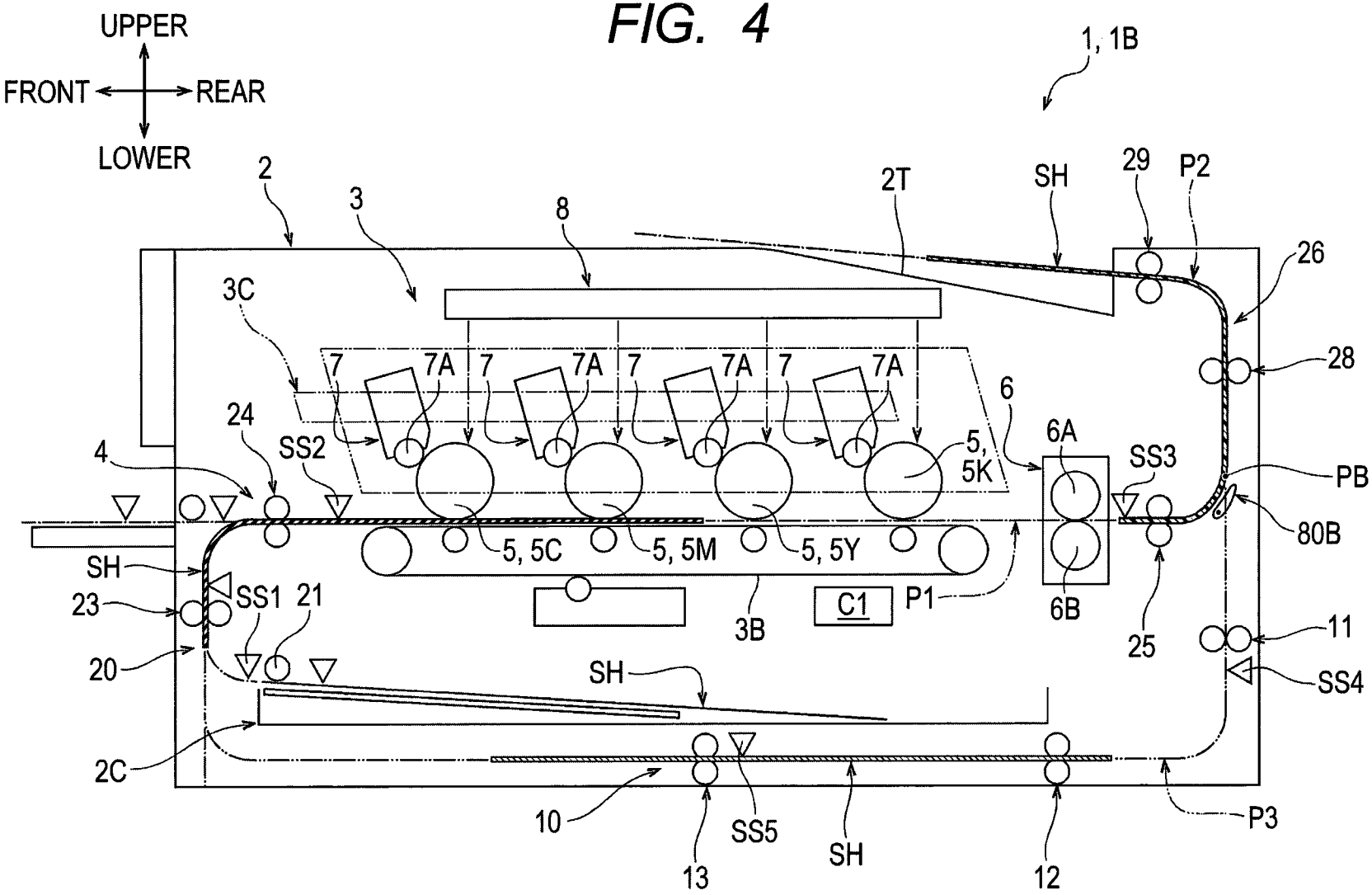
FIG. 4 is a schematic cross-sectional view similar to FIG. 3, showing a state in which three sheets are simultaneously conveyed inside an apparatus main body.

The image forming apparatus 1 (1B) shown in FIGS. 3 and 4 is a "2416" model (an example of second conveyance type) capable of executing "2416" control. As shown in FIG. 4, the image forming apparatus 1 (1B) is configured to simultaneously convey three sheets SH inside the apparatus main body 2.

As shown in FIG. 1, the image forming apparatus 1 (1A) includes a reversing path P4 and a switchback roller pair 18, and a third motor M3 drives a reconveyance roller pair 11 and the switchback roller pair 18. The image forming apparatus 1 (1A) further includes a flapper 80A and a solenoid S1.

As shown in FIG. 3, the image forming apparatus 1 (1B) does not include the reversing path P4 and the switchback roller pair 18, and the third motor M3 drives only the reconveyance roller pair 11. Further, the image forming apparatus 1 (1B) does not include the flapper 80A and the solenoid S1, but instead includes a flapper 80B and a spring (not shown).

The other configurations of the image forming apparatus 1 (1A) and the other configurations of the image forming apparatus 1 (1B) are the same. Thus, in the following description, the configuration of the image forming apparatus 1 (1A) will be described in detail, and the image forming apparatus 1 (1B) will be described focusing on the differences from the image forming apparatus 1 (1A).

<Overall Configuration of Image Forming Apparatus>

As shown in FIG. 1, the image forming apparatus 1 (1A) includes the apparatus main body 2, an image forming unit (print engine) 3, a conveyor 4, and a controller C1.

The apparatus main body 2 includes a sheet tray 2C. The sheet tray 2C is located at the bottom of the apparatus main body 2. The sheet tray 2C is a substantially box-shaped body with an open upper portion, and accommodates a plurality of sheets SH in a stacked state. The sheet SH is a postcard, an envelope, A4 size plain paper, A3 size plain paper, glossy paper, and so on.

The apparatus main body 2 includes a discharge tray 2T. The discharge tray 2T is located at the upper surface of the apparatus main body 2. The discharge tray 2T supports the sheet SH for which image formation is finished.

<Conveyance Path, Discharge Path, Reconveyance Path, and Reversing Path>

The apparatus main body 2 includes a conveyance path P1, a discharge path P2, a reconveyance path P3, and a reversing path P4.

The conveyance path P1 extends upward from the front end of the sheet tray 2C so as to be curved in a U shape, then extends substantially horizontally rearward, and further turns upward at the rear side of the apparatus main body 2 to reach a branch point PB.

The discharge path P2 extends upward from the branch point PB and then turns forward to reach the discharge tray 2T. The discharge path P2 also serves as a reversing path for reversing the sheet SH to be reconveyed and guiding the same to the reconveyance path P3.

The reconveyance path P3 extends downward from the branch point PB, then turns forward below the sheet tray 2C, extends substantially horizontally at the bottom of the apparatus main body 2, and further turns upwards at the front side of the apparatus main body 2 to join the conveyance path P1.

The reversing path P4 extends from the branch point PB so as to incline upward toward the rear, and then extends upward. The reversing path P4 is a path for reversing the sheet SH to be reconveyed and guiding the same to the reconveyance path P3.

That is, the image forming apparatus 1 (1A) includes two reversing paths, that is, the discharge path P2 and the reversing path P4. On the other hand, as shown in FIG. 3, the image forming apparatus 1 (1B) includes one reversing path, that is, the discharge path P2.

<Controller>

The controller C1 includes a calculation unit mainly composed of a CPU, ROM, and RAM (not shown) and hardware for controlling a semiconductor laser, a motor, and so on.

Figure 6:
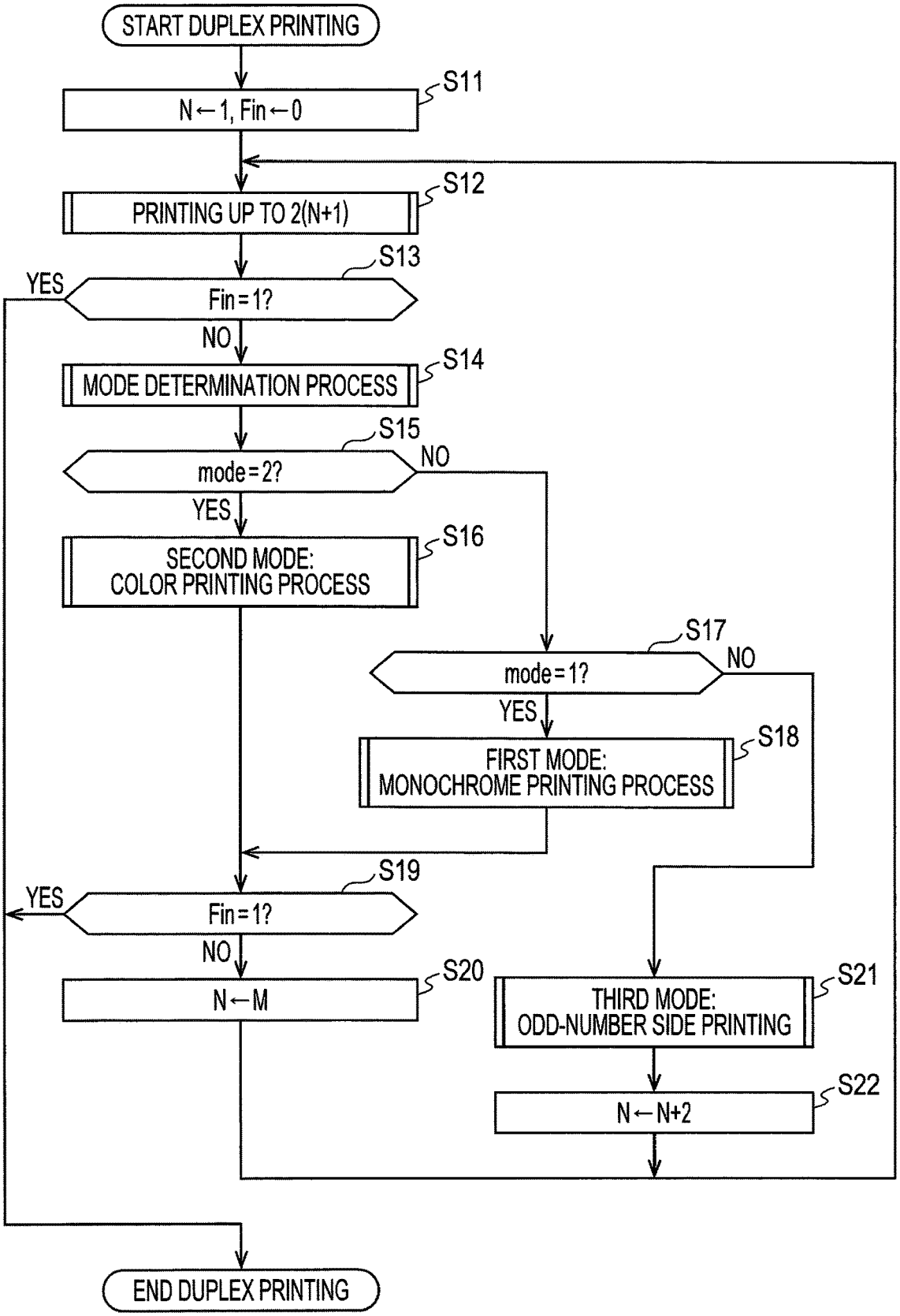
FIG. 6 is a flowchart of a duplex printing program.

The ROM stores programs for the CPU to control various operations of the image forming apparatus 1 and programs for executing determination processes, for example, a duplex printing program shown in FIG. 6.

The RAM includes a storage area for temporarily storing data and signals used by the CPU when executing the above program, or a work area for data processing. The controller C1 controls an entirety of the image forming apparatus 1 including the image forming unit 3 and the conveyor 4.

<Conveyor>

As shown in FIG. 1, the conveyor 4 of the image forming apparatus 1 (1A) includes a feed unit 20, a post-fixing conveyance roller pair 25, a discharge unit 26, the switchback roller pair 18, and a reconveyance unit 10. The conveyor 4 of the image forming apparatus 1 (1A) includes the flapper 80A and the solenoid S1 located in the vicinity of the branch point PB.

As shown in FIG. 3, the conveyor 4 of the image forming apparatus 1 (1B) includes the feed unit 20, the post-fixing conveyance roller pair 25, the discharge unit 26, and the reconveyance unit 10. The conveyor 4 of the image forming apparatus 1 (1B) includes the flapper 80B located in the vicinity of the branch point PB and the spring (not shown).

As shown in FIG. 1, the feed unit 20 is located at the front portion of the apparatus main body 2. The feed unit 20 feeds the sheet SH accommodated in the sheet tray 2C to the conveyance path P1 by a feed roller 21. Then, the feed unit 20 conveys the sheet SH toward the image forming unit 3 by the conveyance roller pair 23 and the registration roller pair 24 located in the conveyance path P1 at the front U-turn section in the apparatus main body 2.

The post-fixing conveyance roller pair 25 is located in the conveyance path P1 between the branch point PB and the fixing unit 6 of the image forming unit 3. The post-fixing conveyance roller pair 25 conveys the sheet SH that has passed through the fixing unit 6 toward the branch point PB.

In the image forming apparatus 1 (1A), the flapper 80A is driven by the solenoid S1 controlled by the controller C1 and swings so as to switch the conveyance destination of the sheet SH that has been conveyed along the conveyance path P1 and has reached the branch point PB between the discharge path P2 or the reversing path P4.

The flapper 80A is configured to, when the sheet SH to be reconveyed is reversed in the discharge path P2 or the reversing path P4 and guided to the reconveyance path P3, be driven by the solenoid S1 and swing to a position that does not hinder the reconveyed sheet SH.

As shown in FIG. 3, in the image forming apparatus 1 (1B), the flapper 80B is urged by a spring (not shown) to be held at a position crossing the conveyance path P1 and separated from the reconveyance path P3. As shown in FIG. 4, the flapper 80B is pushed by the sheet SH conveyed along the conveyance path P1 and swings against the urging force of the spring, and guides the sheet SH that has reached the branch point PB to the discharge path P2.

The flapper 80B is configured to, when the sheet SH to be reconveyed is reversed in the discharge path P2 and guided to the reconveyance path P3, be urged by the spring and held at a position that does not hinder the reconveyed sheet SH.

As shown in FIG. 1, the discharge unit 26 includes a pre-discharge conveyance roller pair 28 and a discharge roller pair 29 located at the upper part at the rear side of the apparatus main body 2.

The pre-discharge conveyance roller pair 28 is located near the branch point PB in the discharge path P2. The discharge roller pair 29 is located near the discharge tray 2T in the discharge path P2.

In the discharge unit 26, the pre-discharge transfer roller pair 28 nips the sheet SH that has passed through the branch point PB and has been guided to the discharge path P2 and conveys the sheet SH toward the discharge roller pair 29, and the discharge roller pair 29 nips and discharges the sheet SH to the discharge tray 2T.

When an image is formed on both sides of the sheet SH, in the discharge unit 26, after the trailing end of the sheet SH discharged halfway by the pre-discharge conveyance roller pair 28 and the discharge roller pair 29 passes through the branch point PB, the rotation direction of the pre-discharge conveyance roller pair 28 and the discharge roller pair 29 is switched to the direction opposite to that during discharge, and thereby reversing and reconveying the sheet SH to the reconveyance path P3.

In the image forming apparatus 1 (1A), the switchback roller pair 18 is located farther rearward than the pre-discharge conveyance roller pair 28 at the rear side of the apparatus main body 2.

The switchback roller pair 18 nips the sheet SH that has passed through the branch point PB and guided to the reversing path P4, and conveys the sheet SH along the reversing path P4. Then, after the trailing end of the sheet SH passes through the branch point PB, the switchback roller pair 18 switches the rotation direction to the direction opposite to that during conveyance, thereby reversing and reconveying the sheet SH to the reconveyance path P3.

The reconveyance unit 10 includes a reconveyance roller pair 11 located at the lower part at the rear side of the apparatus main body 2, and an oblique conveyance roller pair 12 and a return roller pair 13 both located at the bottom of the apparatus main body 2.

The reconveyance roller pair 11 is located in the middle of a portion extending downward from the branch point PB in the reconveyance path P3. The oblique conveyance roller pair 12 is located at a portion extending substantially horizontally on the rear side of the apparatus main body 2 in the reconveyance path P3. The return roller pair 13 is located at a portion extending substantially horizontally in the middle portion in the re-conveyance path P3 in the front-rear direction of the apparatus main body 2.

In the reconveyance unit 10, the reconveyance roller pair 11, the oblique conveyance roller pair 12, and the return roller pair 13 sequentially nip and convey the sheet SH that has passed through the branch point PB and has been guided to the reconveyance path P3, so that the sheet SH merges to a position between the feed roller 21 and the conveyance roller pair 23 in the conveyance path P1.

<First to Third Motors, First and Second Electromagnetic Clutches, and a Plurality of Sheet Sensors>

The conveyor 4 includes a first motor M1, a second motor M2, a third motor M3, a first electromagnetic clutch CL1, a second electromagnetic clutch CL2, a plurality of sheet sensors SS1 to SS5.

The first motor M1 is controlled by the controller C1 to switch between stop and forward rotation. Each of the second motor M2 and the third motor M3 is controlled by the controller C1 to switch among stop, forward rotation, and reverse rotation.

Each of the first electromagnetic clutch CL1 and the second electromagnetic clutch CL2 is controlled by the controller C1 to switch between a connected state in which the driving force is transmitted and a disconnected state in which the driving force is not transmitted.

The first electromagnetic clutch CL1 is interposed between the first motor M1 and the feed roller 21. The second electromagnetic clutch CL2 is interposed between the first motor M1; and the oblique conveyance roller pair 12 and the return roller pair 13.

The sheet sensor SS1 detects the sheet SH passing between the feed roller 21 and the conveyance roller pair 23 in the conveyance path P1. The sheet sensor SS2 detects the sheet SH passing between the registration roller pair 24 and the image forming unit 3 in the conveyance path P1. The sheet sensor SS3 detects the sheet SH passing between the fixing unit 6 and the post-fixing conveyance roller pair 25 in the conveyance path P1.

The sheet sensor SS4 detects the sheet SH passing between the reconveyance roller pair 11 and the oblique conveyance roller pair 12 in the reconveyance path P3 in the vicinity of the reconveyance roller pair 11. The sheet sensor SS5 detects the sheet SH passing between the oblique conveyance roller pair 12 and the return roller pair 13 in the reconveyance path P3 in the vicinity of the return roller pair 13.

Each of the sheet sensors SS1 to SS5 transmits the detection result to the controller C1. When conveying the sheet SH and forming an image, the controller C1 controls the first to third motors M1 to M3 and the first and second electromagnetic clutches CL1 and CL2 based on the detection results of the sheet sensors SS1 to SS5 and so on.

When the first motor M1 switches from stop to forward rotation, the driving force is transmitted to the first electromagnetic clutch CL1 and the second electromagnetic clutch CL1, and the driving force is transmitted to the post-fixing conveyance roller pair 25 and thereby the post-fixing conveyance roller pair 25 rotates in the direction of conveying the sheet SH.

In this state, when the first electromagnetic clutch CL1 is switched from the disconnected state to the connected state, the feed roller 21 rotates in the direction of conveying the sheet SH. Further, in this state, when the second electromagnetic clutch CL2 is switched from the disconnected state to the connected state, the oblique conveyance roller pair 12 and the return roller pair 13 rotate in the direction of reconveying the sheet SH.

When the second motor M2 switches from stop to forward rotation, the pre-discharge conveyance roller pair 28 and the discharge roller pair 29 rotate in the direction of discharging the sheet SH in the discharge path P2 to the discharge tray 2T. When the second motor M2 switches from forward rotation to reverse rotation, the pre-discharge conveyance roller pair 28 and the discharge roller pair 29 rotate in the direction opposite to that during discharge, that is, the direction in which the sheet SH in the discharge path P2 is reconveyed.

In the image forming apparatus 1 (1A), when the third motor M3 switches from stop to forward rotation, the switchback roller pair 18 rotates in the direction of conveying the sheet SH in the reversing path P4. At this time, the reconveyance roller pair 11 also rotates in the direction opposite to the direction in which the sheet SH is reconveyed, but does not contact the sheet SH. When the third motor M3 switches from forward rotation to reverse rotation, the switchback roller pair 18 rotates in the direction opposite to that during conveyance, that is, in the direction in which the sheet SH in the reversing path P4 is reconveyed, and also the reconveyance roller pair 11 rotates in the direction of reconveying the sheet SH.

As shown in FIG. 3, in the image forming apparatus 1 (1B), when the third motor M3 switches from stop to forward rotation, the reconveyance roller pair 11 rotates in the direction of reconveying the sheet SH. In the image forming apparatus 1 (1B), the third motor M3 does not need to rotate in the reverse direction.

Although not shown, the conveyor 4 includes a motor, a driving force transmission mechanism, and so on for driving the registration roller pair 24, a transfer belt 3B to be described later, and the fixing unit 6. When conveying the sheet SH and forming an image, the controller C1 controls the motor, the driving force transmission mechanism, and so on (not shown) based on the detection results of the sheet sensors SS1 to SS5 and so on.

As shown in the example in FIG. 2, in the image forming apparatus 1 (1A), the controller C1 controls the first to third motors M1 to M3, the first and second electromagnetic clutches CL1, CL2, the motor, the driving force transmission mechanism, and so on (not shown) based on the detection results of the sheet sensors SS1 to SS5 and so on, so that the conveyor 4 simultaneously conveys four or more sheets SH inside the apparatus main body 2.

As shown in the example in FIG. 4, in the image forming apparatus 1 (1B), the controller C1 controls the first to third motors M1 to M3, the first and second electromagnetic clutches CL1, CL2, the motor, the driving force transmission mechanism, and so on (not shown) based on the detection results of the sheet sensors SS1 to SS5 and so on, so that the conveyor 4 simultaneously conveys three sheets SH inside the apparatus main body 2.

<Image Forming Unit (Print Engine)>

As shown in FIG. 1, the image forming unit 3 is located above the sheet tray 2C in the apparatus main body 2. The sheet SH conveyed toward the image forming unit 3 by the feed unit 20 passes through the image forming unit 3 at a portion extending substantially horizontally in the conveyance path P1.

The image forming unit 3 is of a direct-transfer type color electrophotographic method. The image forming unit 3 includes four sets of process cartridges 7 each having a development roller 7A and photosensitive drums 5. Further, the image forming unit 3 includes a switching mechanism 3C, the transfer belt 3B, a scanner unit 8, the fixing unit 6, and so on.

The photosensitive drums 5 correspond to toner of four colors of black, yellow, magenta, and cyan, and are arranged in series along a substantially horizontal portion of the conveyance path P1. Each photosensitive drum 5 is a cylindrical rotating body. A positively charged photosensitive layer is formed on the surface of each photosensitive drum 5. A charger (not shown) is provided in the vicinity of each photosensitive drum 5.

The switching mechanism 3C supports the process cartridges 7. Each process cartridge 7 is located at a farther upward and forward position than the corresponding photosensitive drum 5. Each process cartridge 7 rotatably supports the development roller 7A at the lower end. Each process cartridge 7 has a toner storage portion therein.

Figure 5A:
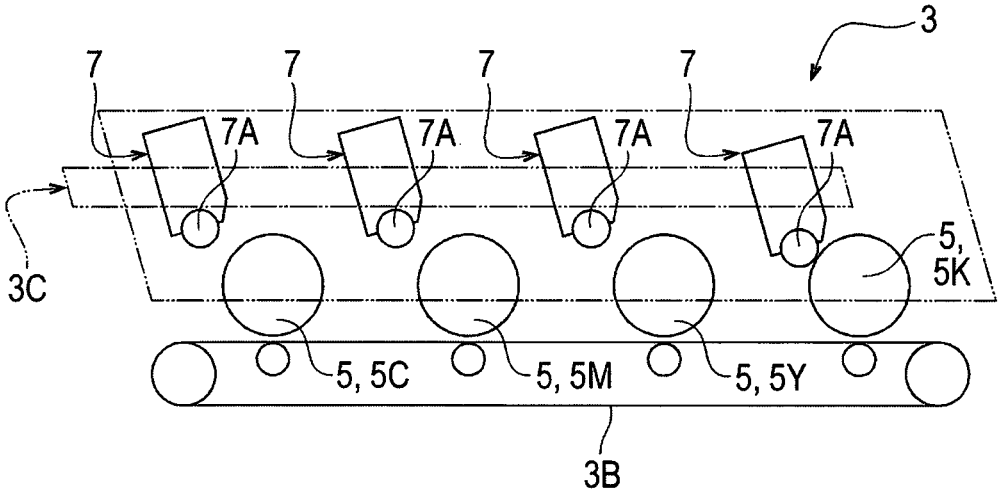
FIGS. 5A and 5B are schematic views illustrating switching between a first state and a second state in an image forming unit, where
Figure 5B:
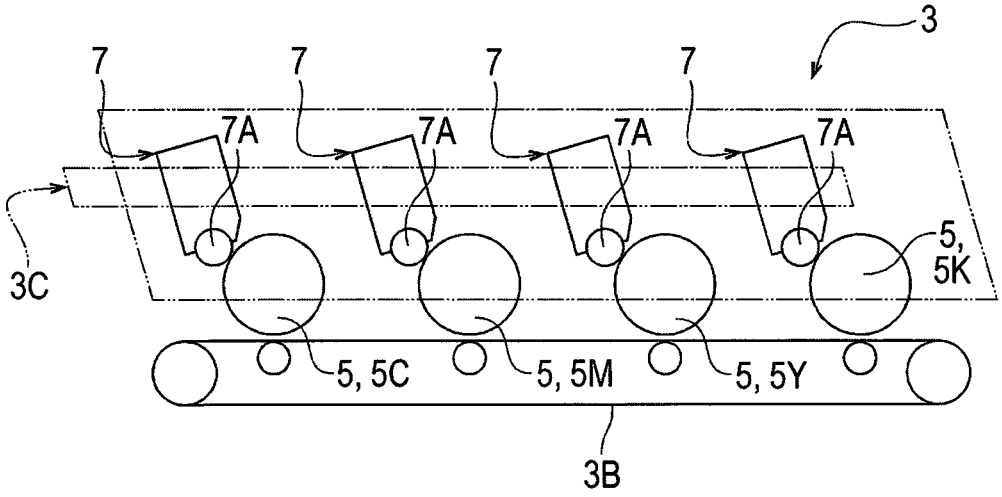

As shown in FIGS. 5A and 5B, the switching mechanism 3C is controlled by the controller C1 to move the process cartridges 7 upward and downward. The development roller 7A and the photosensitive drum 5 are configured to contact and separate from each other by upward and downward movement of the process cartridge 7.

Although not shown, the switching mechanism 3C includes a rail for guiding the process cartridge 7, a cam for pushing the process cartridge 7 in one of upward or downward directions, an urging spring for urging the process cartridge 7 in the other one of upward or downward directions, and so on.

The image forming unit 3 is switched between the first state shown in FIG. 5A and the second state shown in FIG. 5B by an operation of the switching mechanism 3C.

The first state shown in FIG. 5A is a state in which one set of development roller 7A and the photosensitive drum 5 (5K) corresponding to black toner contact each other in order to form a monochrome image while the other sets, that is, the three sets of the development roller 7A and the photosensitive drum 5 (5C, 5M, 5Y) corresponding to the yellow, magenta, and cyan toner are separated from each other.

In the first state, the operating time of the three development rollers for forming a color image is reduced, and the life of these development rollers is extended.

The second state shown in FIG. 5B is a state in which all the sets of the development roller 7A and the photosensitive drum 5 (5C, 5M, 5Y, 5K) contact each other in order to form a color image.

As shown in FIG. 1, the transfer belt 3B is located below the substantially horizontal portion of the conveyance path P1 and faces each photosensitive drum 5 from below. The transfer belt 3B circulates while nipping the conveyed sheet SH together with each photosensitive drum 5.

The scanner unit 8 is located above the process cartridges 7. The scanner unit 8 includes a laser light source, a polygon mirror, an fθ lens, a reflecting mirror, and so on. The scanner unit 8 irradiates each photosensitive drum 5 with a laser beam from above.

The fixing unit 6 is located rearward of the photosensitive drums 5 and the transfer belt 3B. The fixing unit 6 includes a heating roller 6A and a pressure roller 6B. The fixing unit 6 heats and pressurizes the sheet SH that has passed under the process cartridges 7 by sandwiching the same between the heating roller 6A and the pressure roller 6B.

The image forming unit 3 forms an image on the sheet SH conveyed along the conveyance path P1 as follows. At this time, when forming a color image on the sheet SH, the image forming unit 3 switches to the second state shown in FIG. 5B.

The surface of each photosensitive drum 5 (5C, 5M, 5Y, 5K) is uniformly positively charged by the charger due to rotation, and then exposed by high-speed scanning of the laser beam emitted from the scanner unit 8. With this operation, an electrostatic latent image corresponding to the image to be formed on the sheet SH is formed on the surface of each photosensitive drum 5. Next, toner is supplied from the toner storage portion to the surface of each photosensitive drum 5 corresponding to the electrostatic latent image. Then, when the sheet SH is conveyed along the conveyance path P1 and passes through the image forming unit 3, the toner borne on the surface of each photosensitive drum 5 is transferred to one side of the sheet SH. Then, in the fixing unit 6, the sheet SH is heated and pressurized to thermally fix the image on the sheet SH.

When forming a monochrome image on the sheet SH, the image forming unit 3 switches to the first state shown in FIG. 5A. Then, a set of the development roller 7A and the photosensitive drum 5 (5K) corresponding to the black toner operate as described above.

In the case of single-sided printing in which an image is not formed on both sides of the sheet SH, the sheet SH that has passed through the fixing unit 6 is guided to the discharge path P2 and discharged to the discharge tray 2T by the discharge unit 26.

In the case of duplex printing in which an image is formed on both sides of the sheet SH, the controller C1 executes the duplex printing program shown in FIG. 6. In this program, a variable "N", a variable "Fin", a variable "M", and a variable "mode" are used.

The variable N is a positive integer. The controller C1 uses the variable N to specify each of the plurality of sheets SH, such as the Nth sheet SH, the (N+1)th sheet SH, and the (N+2)th sheet SH.

The variable Fin is a flag for determining the end of printing. If printing is not ended, the variable Fin is 0. When printing is ended, the variable Fin is 1.

The variable M is a positive integer. The controller C1 uses the variable M to specify the sheet SH when the sheet SH to be conveyed is not conveyed.

The controller C1 uses the variable mode to specify one of the first to third modes. In the first mode, the variable mode is 1. In the second mode, the variable mode is 2. In the third mode, the variable mode is 3.

When duplex printing is performed, the controller C1 prints even-number (2N) pages before odd-number (2N−1) pages so that a side facing downward of an Nth sheet SH discharged to the discharge tray 2T is an odd-number (2N−1) page and a side facing upward of the sheet SH is an even-number (2N) page.

First, in step S11 (hereinafter, "step" will be abbreviated as "S"), the controller C1 assigns 1 to the variable N and 0 to the variable Fin.

Figure 7:
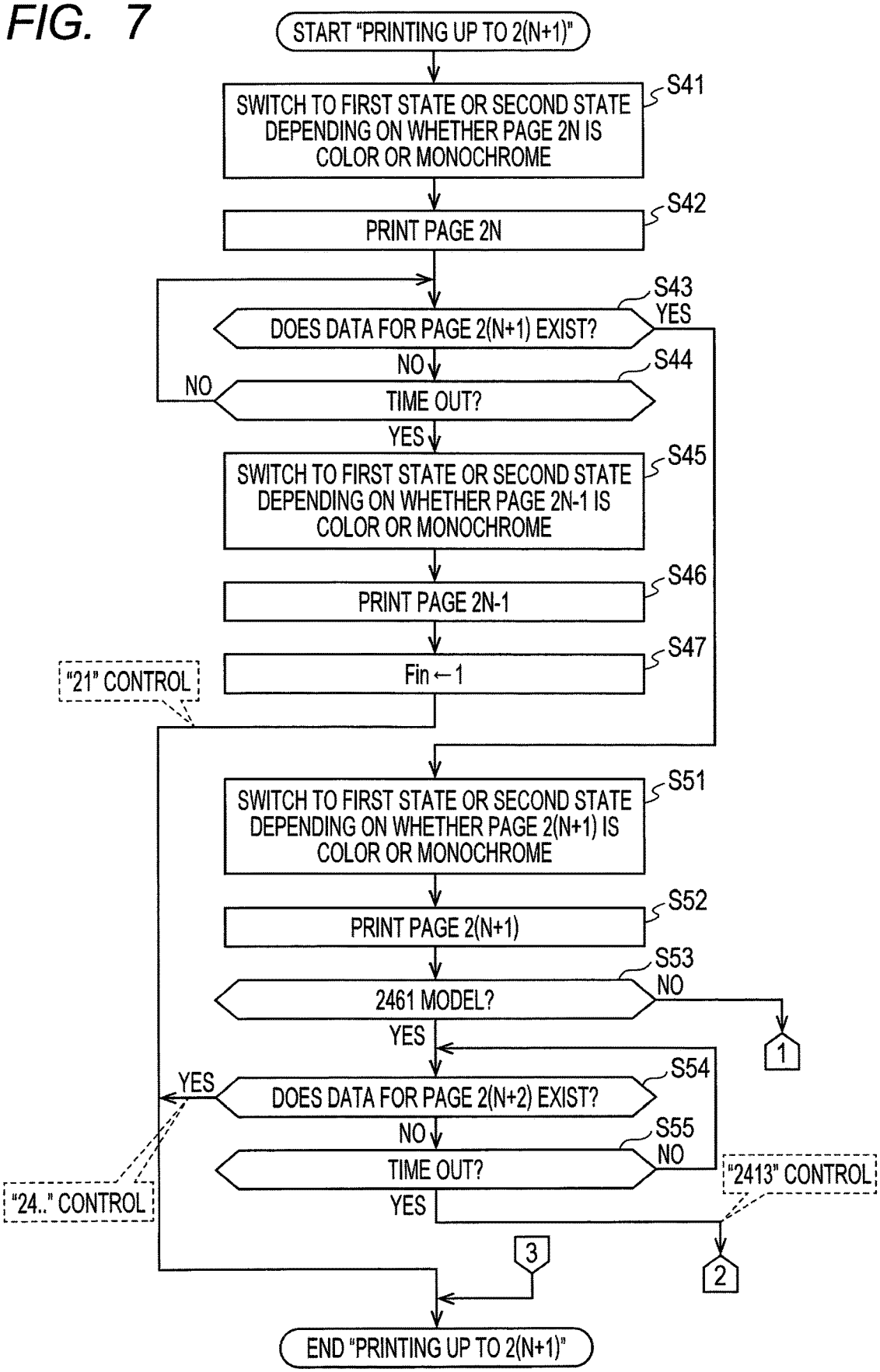
FIG. 7 is a flowchart of a part of a "printing up to 2(N+1)" subroutine.

Next, the controller C1 proceeds to S12 and starts the "printing up to 2(N+1)" subroutine shown in FIG. 7.

When the controller C1 proceeds to S41, if the image formed on the even-number page of the Nth sheet SH, that is, page 2N is a color image, the controller C1 controls the switching mechanism 3C to switch the image forming unit 3 to the second state. If the image formed on the page 2N is a monochrome image, the controller C1 controls the switching mechanism 3C to switch the image forming unit 3 to the first state.

When the state of the image forming unit 3 is already in the state to be switched, the controller C1 does not perform switching.

Next, the controller C1 proceeds to S42 and prints page 2N.

Next, the controller C1 proceeds to S43 and determines whether data of the even-number page of the (N+1)th sheet SH, that is, page 2(N+1) exists. If "Yes" is obtained in S43, the controller C1 proceeds to S51. The processing after S51 will be described later. If "No" is obtained in S43, the controller C1 proceeds to S44.

When the controller C1 proceeds to S44, the controller C1 determines whether a timeout has occurred. If a waiting time has not elapsed, "No" is obtained in S44, so the controller C1 returns to S43. When the waiting time has elapsed, "Yes" is obtained in S44, so the controller C1 proceeds to S45.

In this embodiment, the controller C1 executes the processing of S43 and S44 using the following conditions as triggers. Specifically, the controller C1 starts the determination in S43 from the timing when the trailing end of the Nth sheet SH on which page 2N is printed in S42 passes through the sheet sensor SS2, and determines in S44 whether a particular waiting time has elapsed.

The controller C1 executes the processing of S54 and S55, the processing of S73 and S74, the processing of S106 and S121, and the processing of S206 and S221, which will be described later, using the same conditions as the processing of S43 and S44 as triggers. The controller C1 may execute the processing of S43, S44 and so on using conditions different from the above as triggers.

When "Yes" is obtained in S44, it means that only one sheet SH is duplex printing during the current execution of this subroutine.

When the controller C1 proceeds to S45, if the image formed on the odd-number page of the Nth sheet SH, that is, page 2N−1, is a color image, the controller C1 controls the switching mechanism 3C to switch the image forming unit 3 to the second state. If the image formed on page 2N−1 is a monochrome image, the controller C1 controls the switching mechanism 3C to switch the image forming unit 3 to the first state.

Next, the controller C1 proceeds to S46 and prints page 2N−1.

Next, the controller C1 proceeds to S47 and assigns 1 to the variable Fin. After that, the controller C1 ends the "printing up to 2(N+1)" subroutine, proceeds to S13 shown in FIG. 6, and determines whether the variable Fin is set to Fin=1. When the processing proceeds from S47 to S13, the result is "Yes", so the duplex printing program ends.

Returning to the "printing up to 2(N+1)" subroutine shown in FIG. 7, when the processing proceeds from S43 to S51, if the image formed on an even-number page of the (N+1)th sheet SH, that is, page 2(N+1), is a color image, the controller C1 controls the switching mechanism 3C to switch the image forming unit 3 to the second state. If the image formed on page 2(N+1) is a monochrome image, the controller C1 controls the switching mechanism 3C to switch the image forming unit 3 to the first state.

Next, the controller C1 proceeds to S52 and prints page 2(N+1).

Next, the controller C1 proceeds to S53 and determines whether the image forming apparatus 1 is the "2461" model. If it is not the image forming apparatus 1 (1A), "No" is obtained in S53, and the processing proceeds to S71 shown in FIG. 8. When it is the image forming apparatus 1 (1A), "Yes" is obtained in S53 shown in FIG. 7, and the processing proceeds to S54.

When the controller C1 proceeds to S54, the controller C1 determines whether data of the even-number page of the (N+2)th sheet SH, that is, page 2(N+2) exists. If "Yes" is obtained in S54, the controller C1 ends the "printing up to 2(N+1)" subroutine, proceeds to S13 shown in FIG. 6, and determines whether the variable Fin is set to Fin=1. When the processing proceeds from S54 to S13, the result is "No", so the controller C1 proceeds to S14. The processing after S14 will be described later. If "No" is obtained in S54 shown in FIG. 7, the controller C1 proceeds to S55.

When the controller C1 proceeds to S55, the controller C1 determines whether a timeout has occurred. If the waiting time has not elapsed, "No" is obtained in S55, so the controller C1 returns to S54. When the waiting time has elapsed, "Yes" is obtained in S55, so the controller C1 proceeds to S61 shown in FIG. 8.

When "Yes" is obtained in S55 shown in FIG. 7, it means that only two sheets SH, that is, only the Nth sheet and the (N+1)th sheet, are duplex printing during the current execution of this subroutine.

Figure 8:
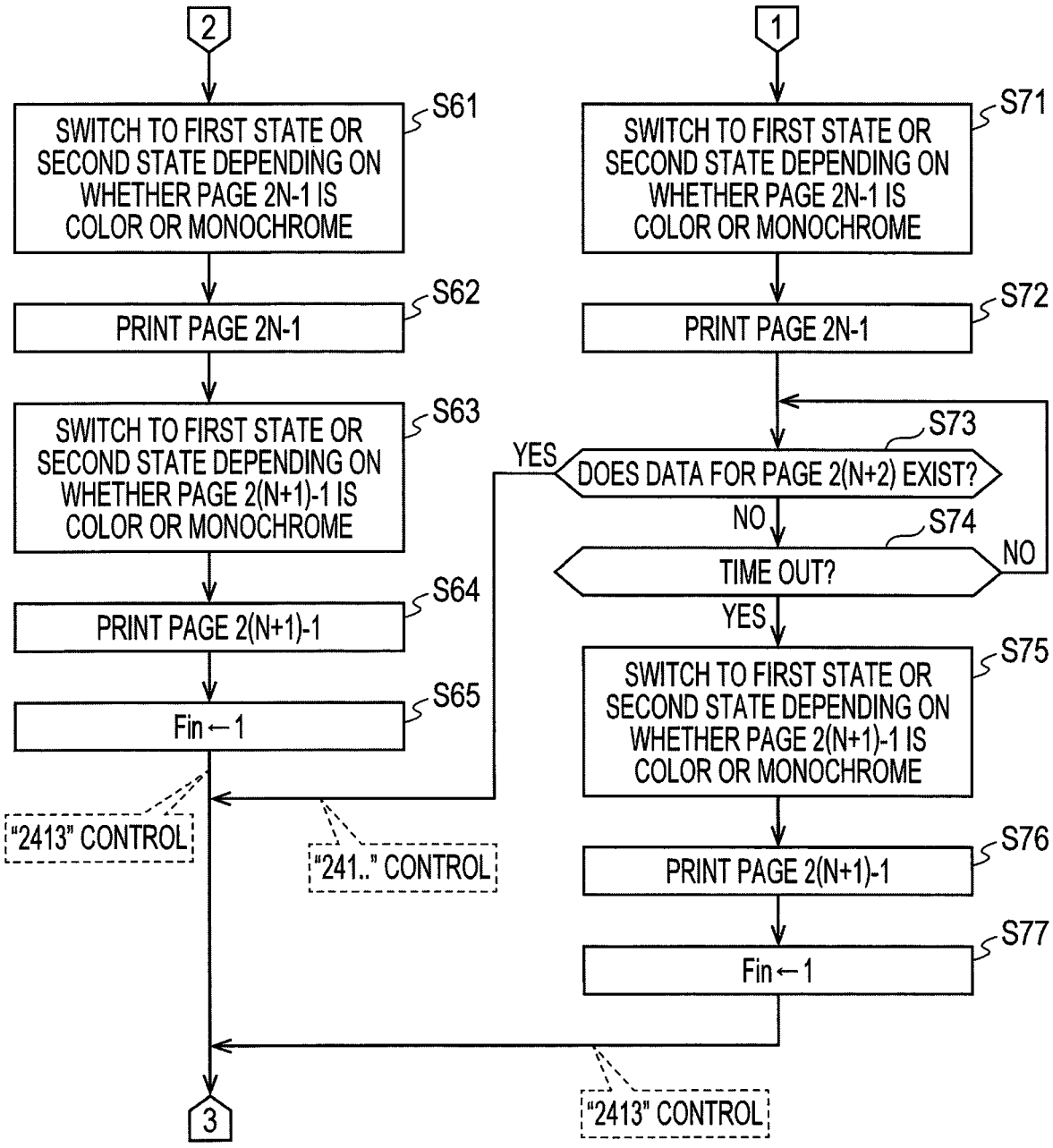
FIG. 8 is a flowchart of a remaining part of the "printing up to 2(N+1)" subroutine.

When the controller C1 proceeds to S61 shown in FIG. 8, if the image formed on the odd-number page of the Nth sheet SH, that is, page 2N−1, is a color image, the controller C1 controls the switching mechanism 3C to switch the image forming unit 3 to the second state. If the image formed on page 2N−1 is a monochrome image, the controller C1 controls the switching mechanism 3C to switch the image forming unit 3 to the first state.

Next, the controller C1 proceeds to S62 and prints page 2N−1.

Next, the controller C1 proceeds to S63, and if the image formed on the odd-number page of the (N+1)th sheet SH, that is, page 2(N+1)−1, is a color image, the controller C1 controls the switching mechanism 3C to switch the image forming unit 3 to the second state. If the image formed on page 2(N+1)−1 is a monochrome image, the controller C1 controls the switching mechanism 3C to switch the image forming unit 3 to the first state. When the state of the image forming unit 3 is already in the state to be switched, the controller C1 does not perform switching.

Next, the controller C1 proceeds to S64 and prints page 2(N+1)−1.

Next, the controller C1 proceeds to S65 and assigns 1 to the variable Fin. As shown in FIG. 7, after that, the controller C1 ends the "printing up to 2(N+1)" subroutine, proceeds to S13 shown in FIG. 6, and determines whether the variable Fin is set to Fin=1. When the processing proceeds from S65 to S13, the result is "Yes", so the duplex printing program ends.

Returning to the "printing up to 2(N+1)" subroutine shown in FIG. 7, when the processing proceeds from S53 to S71 shown in FIG. 8, if the image formed on the odd-number page of the Nth sheet SH, that is, page 2N−1, is a color image, the controller C1 controls the switching mechanism 3C to switch the image forming unit 3 to the second state. If the image formed on page 2N−1 is a monochrome image, the controller C1 controls the switching mechanism 3C to switch the image forming unit 3 to the first state. When the state of the image forming unit 3 is already in the state to be switched, the controller C1 does not perform switching.

Next, the controller C1 proceeds to S72 and prints page 2N−1.

Next, the controller C1 proceeds to S73 and determines whether data of even-number pages of (N+2)th sheet SH, that is, page 2(N+2) exists. As shown in FIG. 7, when "Yes" is obtained in S73, the controller C1 ends the "printing up to 2(N+1)" subroutine, proceeds to S13 shown in FIG. 6 and determines whether the variable Fin is set to Fin=1. When the processing proceeds from S73 to S13, the result is "No", so the controller C1 proceeds to S14. The processing after S14 will be described later. If "No" is obtained in S73 shown in FIG. 8, the controller C1 proceeds to S74.

When the controller C1 proceeds to S74, the controller C1 determines whether a timeout has occurred. If the waiting time has not elapsed, "No" is obtained in S74, so the controller C1 returns to S73. When the waiting time has elapsed, "Yes" is obtained in S74, so that the controller C1 proceeds to S75.

When "Yes" is obtained in S74, it means that there are only two sheets SH, that is, only the Nth sheet and the (N+1)th sheet, in duplex printing during the current execution of this subroutine.

When the controller C1 proceeds to S75, if the image formed on the odd-number page of the (N+1)th sheet SH, that is, page 2(N+1)−1, is a color image, the controller C1 controls the switching mechanism 3C to switch the image forming unit 3 to the second state. If the image formed on page 2(N+1)−1 is a monochrome image, the controller C1 controls the switching mechanism 3C to switch the image forming unit 3 to the first state. When the state of the image forming unit 3 is already in the state to be switched, the controller C1 does not perform switching.

Next, the controller C1 proceeds to S76 and prints page 2(N+1)−1.

Next, the controller C1 proceeds to S77 and assigns 1 to the variable Fin. As shown in FIG. 7, after that, the controller C1 ends the "printing up to 2(N+1)" subroutine, proceeds to S13 shown in FIG. 6, and determines whether the variable Fin is set to Fin=1. When the processing proceeds from S77 to S13, the result is "Yes", so the duplex printing program ends.

Figure 9:
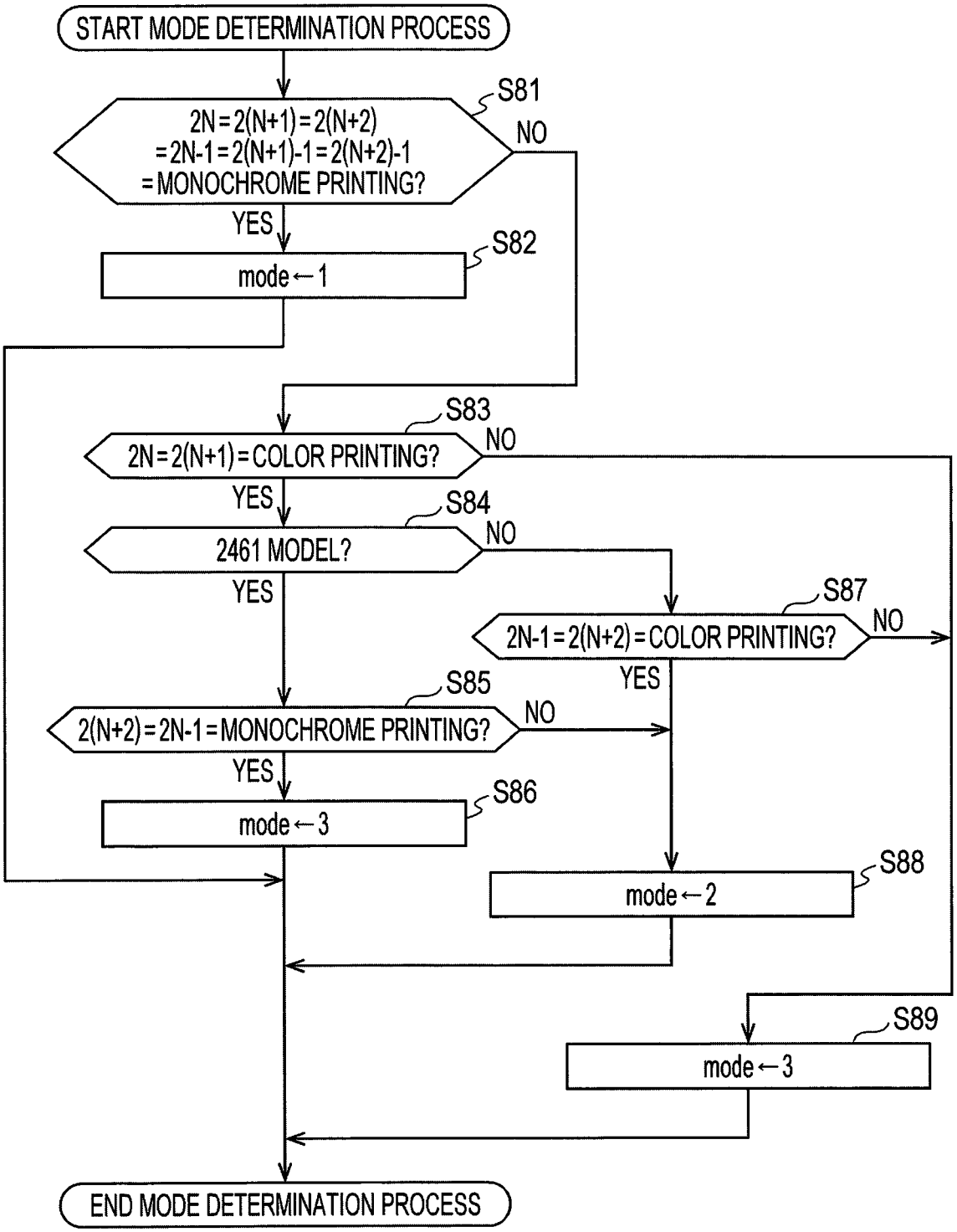
FIG. 9 is a flowchart of a "mode determination process" subroutine.

Returning to the duplex printing program shown in FIG. 6, when the processing proceeds from S13 to S14, the controller C1 starts "mode determination process" subroutine shown in FIG. 9.

When the controller C1 proceeds to S81, the controller C1 determines whether all the images formed on both sides of the Nth sheet, the (N+1)th sheet, and the (N+2)th sheet SH are monochrome images, that is, whether all the images formed on page 2N, page 2(N+1), page 2(N+2), page 2N−1, page 2(N+1)−1, and page 2(N+2)−1 are monochrome images.

When "Yes" is obtained in S81, the controller C1 proceeds to S82, assigns 1 to the variable mode, ends the "mode determination process" subroutine, and proceeds to S15 shown in FIG. 6. The processing after S15 will be described later. If "No" is obtained in S81 shown in FIG. 9, the controller C1 proceeds to S83.

When the controller C1 proceeds to S83, the controller C1 determines whether all the images formed on the even-number pages of the Nth sheet and the (N+1)th sheet SH are color images, that is, whether the images formed on page 2N and page 2(N+1) are color images.

When "No" is obtained in S83, the controller C1 proceeds to S89, assigns 3 to the variable mode, ends the "mode determination process" subroutine, and proceeds to S15 shown in FIG. 6. When "Yes" is obtained in S83 shown in FIG. 9, the controller C1 proceeds to S84.

When the controller C1 proceeds to S84, the controller C1 determines whether the image forming apparatus 1 is the "2461" model. When it is the image forming apparatus 1 (1A), "Yes" is obtained in S84, and the processing proceeds to S85. If it is not the image forming apparatus 1 (1A), "No" is obtained in S84, and the processing proceeds to S87.

When the controller C1 proceeds to S85, the controller C1 determines whether both the image formed on the even-number page of the (N+2)th sheet SH and the image formed on the odd-number page of the Nth sheet SH are monochrome images, that is, whether both the images formed on page 2(N+2) and page 2N−1 are monochrome images.

If at least one of the image formed on the even-number page of the (N+2)th sheet SH and the image formed on the odd-number page of the Nth sheet SH is not a monochrome image, "No" is obtained in S85, so the controller C1 proceeds to S88.

When "Yes" is obtained in S85, the controller C1 proceeds to S86, assigns 3 to the variable mode, ends the "mode determination process" subroutine, and proceeds to S15 shown in FIG. 6.

When the processing proceeds from S84 to S87 shown in FIG. 9, the controller C1 determines whether both the image formed on the odd-number page of the Nth sheet SH and the image formed on the even-number page of the (N+2)th sheet SH are color images, that is, whether both the images formed on page 2N−1 and page 2(N+2) are color images.

If both the image formed on the odd-number page of the Nth sheet SH and the image formed on the even-number page of the (N+2)th sheet SH are color images, "Yes" is obtained in S87, so that the controller C1 proceeds to S88.

When "No" is obtained in S87, the controller C1 proceeds to S89, assigns 3 to the variable mode, ends the "mode determination process" subroutine, and proceeds to S15 shown in FIG. 6.

When the processing proceeds from S85 or S87 to S88 shown in FIG. 9, the controller C1 assigns 2 to the variable mode, ends the "mode determination process" subroutine, and proceeds to S15 shown in FIG. 6.

That is, in the "mode determination process" subroutine, the controller C1 selects the first mode when all the images formed on both sides of the Nth sheet, the (N+1)th sheet, and the (N+2)th sheet SH are monochrome images. The controller C1 selects the second mode when all the images formed on both sides of the Nth sheet, the (N+1)th sheet, and the (N+2)th sheet SH are color images. When the images formed on both sides of the Nth sheet, the (N+1)th sheet, and the (N+2)th sheet SH are a mixture of monochrome and color images, the controller C1 selects the third mode with some exceptions and selects the second mode for the exceptions.

Returning to the duplex printing program shown in FIG. 6, when the processing proceeds from S14 to S15, the controller C1 determines whether the variable mode is set to mode=2. If "Yes" is obtained in S15, the controller C1 proceeds to S16 and starts the "second mode: color printing process" subroutine shown in FIG. 11.

When "No" is obtained in S15 shown in FIG. 6, the controller C1 proceeds to S17 and determines whether the variable mode is set to mode=1. If "Yes" is obtained in S17, the controller C1 proceeds to S18 and starts the "first mode: monochrome printing process" subroutine shown in FIG. 10.

If "No" is obtained in S17 shown in FIG. 6, the controller C1 proceeds to S21 and starts the "third mode: odd-number side printing" subroutine shown in FIG. 12.

Figure 10:
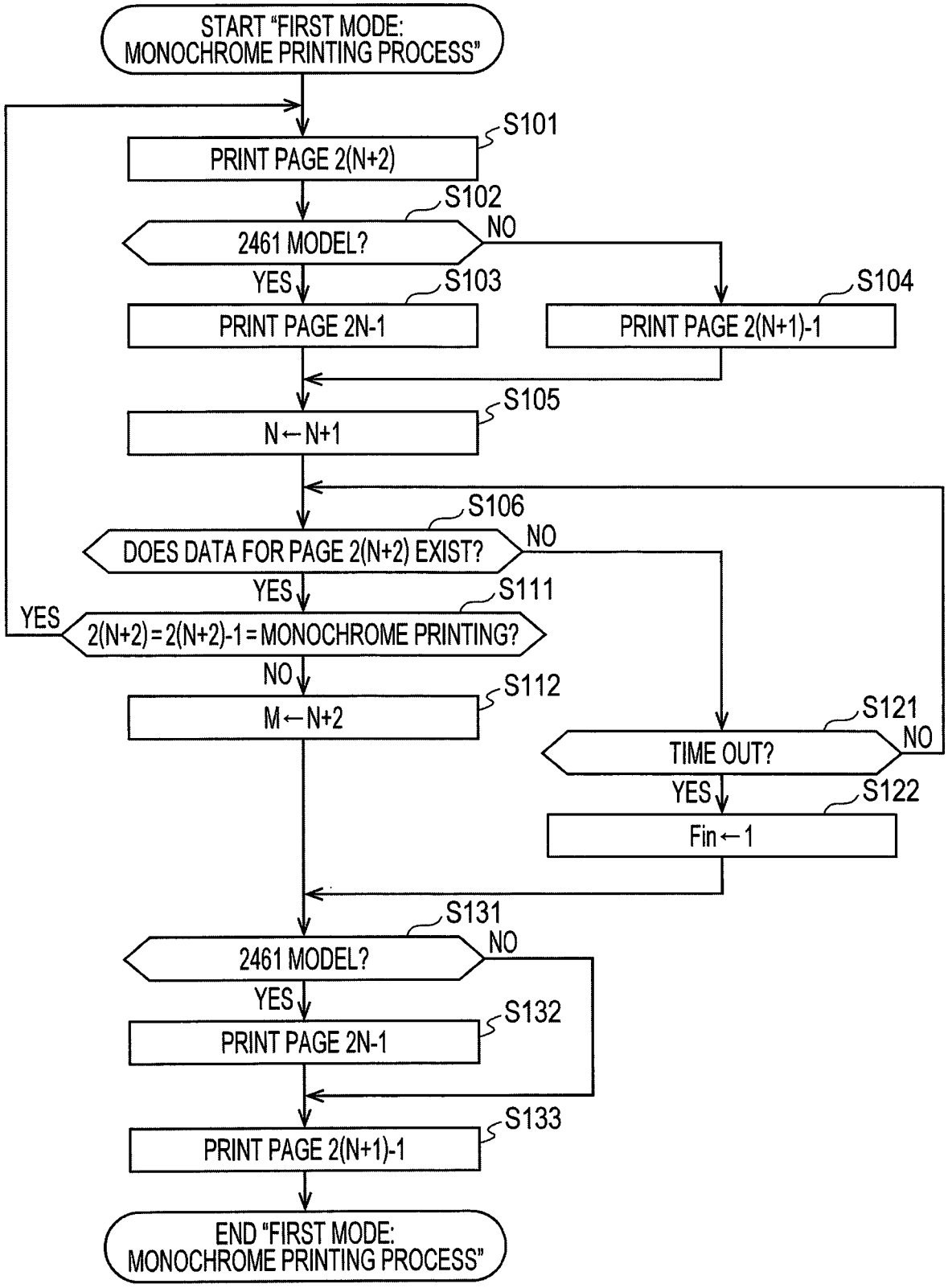
FIG. 10 is a flowchart of a "first mode: monochrome printing process" subroutine.

When the controller C1 starts the "first mode: monochrome printing process" subroutine shown in FIG. 10, the controller C1 controls the switching mechanism 3C to switch the image forming unit 3 to the first state. When the image forming unit 3 is already in the first state, the controller C1 does not perform switching.

Then, the controller C1 proceeds to S101 and prints page 2(N+2).

The printing of page 2(N+2) in S101 corresponds to "when all the images formed on both sides of the Nth sheet, the (N+1)th sheet, and the (N+2)th sheet are monochrome images, the (N+2)th sheet is conveyed to the image forming unit and an image is formed thereon before forming an image on both sides of the (N+1)th sheet".

Next, the controller C1 proceeds to S102 and determines whether the image forming apparatus 1 is the "2461" model.

When it is the image forming apparatus 1 (1A), "Yes" is obtained in S102, and the processing proceeds to S103. Then, after printing page 2N−1, the controller C1 proceeds to S105.

If it is not the image forming apparatus 1 (1A), "No" is obtained in S102, and the processing proceeds to S104. Then, after printing page 2(N+1)−1, the controller C1 proceeds to S105.

When the processing proceeds from S103 or S104 to S105, the controller C1 assigns N+1 to the variable N.

Next, the controller C1 proceeds to S106 and determines whether data of the even-number page of the (N+2)th sheet SH, that is, page 2(N+2) exists. The (N+2)th sheet SH in S106 corresponds to the "sheet to be conveyed after the (N+2)th sheet" by assigning N+1 to the variable N each time S105 is executed.

If "Yes" is obtained in S106, the controller C1 proceeds to S111. The processing after S111 will be described later. If "No" is obtained in S106, the controller C1 proceeds to S121.

When the controller C1 proceeds to S121, the controller C1 determines whether a timeout has occurred. If the waiting time has not elapsed, "No" is obtained in S121, so the controller C1 returns to S106. When the waiting time has elapsed, "Yes" is obtained in S121, so the controller C1 proceeds to S122.

When the controller C1 proceeds to S122, the controller C1 assigns 1 to the variable Fin and proceeds to S131. The processing after S131 will be described later.

When the processing proceeds from S106 to S111, the controller C1 determines whether all the images formed on page 2(N+2) and page 2(N+2)−1 are monochrome images. If "Yes" is obtained in S111, the controller C1 returns to S101. If "No" is obtained in S111, the controller C1 proceeds to S112.

The case where the "first mode: monochrome printing process" subroutine is started and "No" is obtained in S111 corresponds to "a case where all the images formed on both sides of the Nth sheet, the (N+1)th sheet, and the (N+2)th sheet are monochrome images and at least one of the images formed on both sides of the sheet to be conveyed subsequent to the (N+2)th sheet and thereafter is not a monochrome image".

When the controller C1 proceeds to S112, the controller C1 assigns N+2 to the variable M and proceeds to S131. As for the (N+2)th sheet SH when "No" is obtained in S111, the sheet was scheduled to be conveyed but is not conveyed during the current execution of the "first mode: monochrome printing process" subroutine.

When the processing proceeds from S112 or S122 to S131, the controller C1 determines whether the image forming apparatus 1 is the "2461" model.

When it is the image forming apparatus 1 (1A), "Yes" is obtained in S131, and the processing proceeds to S132. Then, after printing page 2N−1, the controller C1 proceeds to S133.

If it is not the image forming apparatus 1 (1A), "No" is obtained in S131, and the processing proceeds to S133.

When the processing proceeds from S131 or S132 to S133, the controller C1 prints page 2(N+1)−1, then ends the "first mode: monochrome printing process" subroutine, and proceeds to S19 shown in FIG. 6. The processing after S19 will be described later.

Page 2N−1 in S132 and page 2(N+1)−1 in S133 are examples of "an odd-number page of a sheet in the middle of conveyance".

Figure 11:
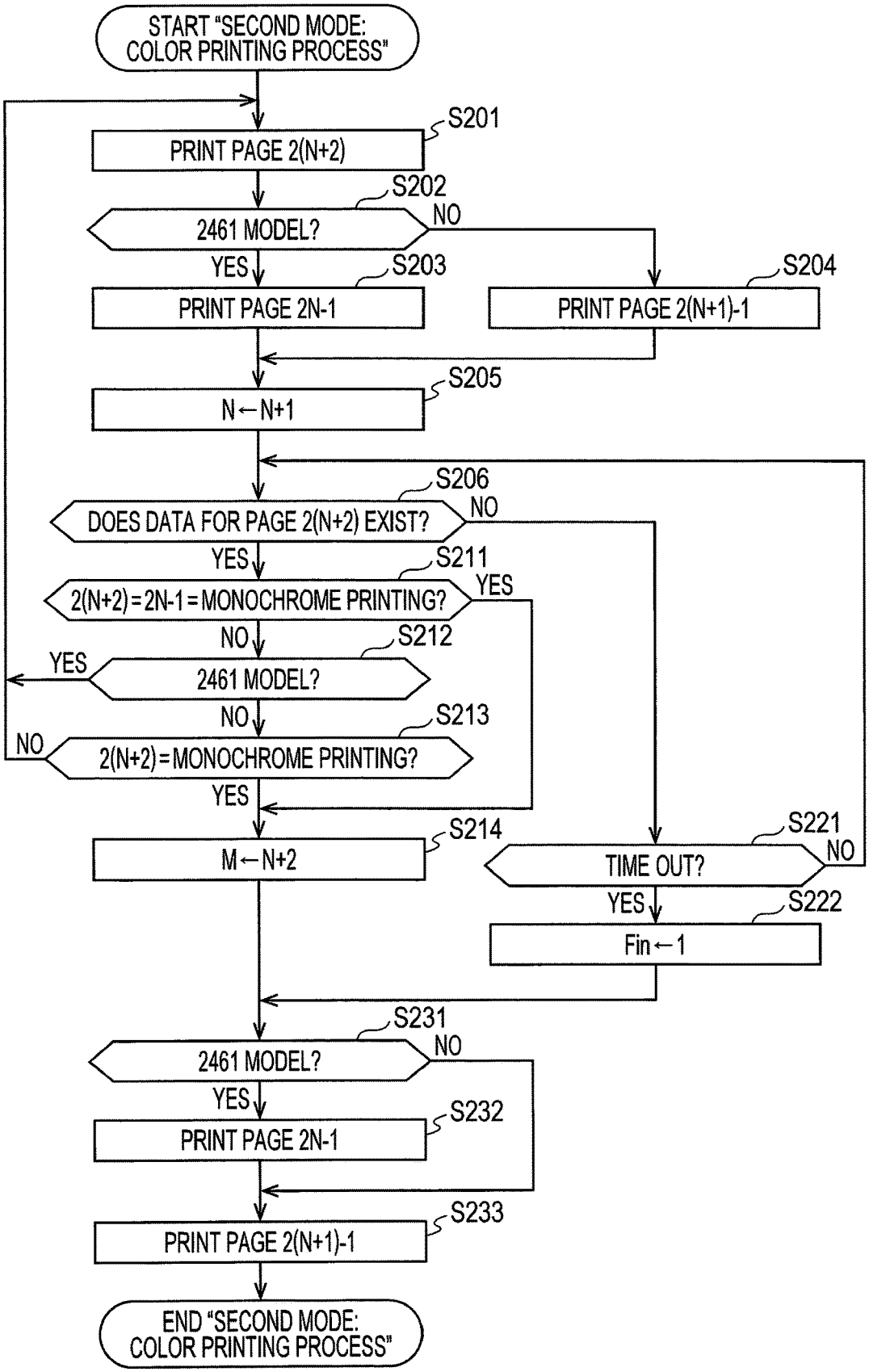
FIG. 11 is a flowchart of a "second mode: color printing process" subroutine.

When the controller C1 starts the "second mode: color printing process" subroutine shown in FIG. 11, the controller C1 controls the switching mechanism 3C to switch the image forming unit 3 to the second state. When the image forming unit 3 is already in the second state, the controller C1 does not perform switching.

Then, the controller C1 proceeds to S201 and prints page 2(N+2).

The printing of page 2(N+2) in S201 corresponds to "when all the images formed on both sides of the Nth sheet, the (N+1)th sheet, and the (N+2)th sheet are color images, the (N+2)th sheet is conveyed to the image forming unit and an image is formed thereon before forming an image on both sides of the (N+1)th sheet".

Next, the controller C1 proceeds to S202 and determines whether the image forming apparatus 1 is the "2461" model.

When it is the image forming apparatus 1 (1A), "Yes" is obtained in S202, and the processing proceeds to S203. Then, after printing page 2N−1, the controller C1 proceeds to S205.

If it is not the image forming apparatus 1 (1A), "No" is obtained in S202, and the processing proceeds to S204. Then, after printing page 2(N+1)−1, the controller C1 proceeds to S205.

When the processing proceeds from S203 or S204 to S205, the controller C1 assigns N+1 to the variable N.

Next, the controller C1 proceeds to S206 and determines whether data of an even-number page of the (N+2)th sheet SH, that is, page 2(N+2) exists. The (N+2)th sheet SH in S206 corresponds to the "sheet to be conveyed subsequent to the (N+2)th sheet and thereafter" by assigning N+1 to the variable N each time S205 is executed.

If "Yes" is obtained in S206, the controller C1 proceeds to S211. The processing after S211 will be described later. If "No" is obtained in S206, the controller C1 proceeds to S221.

When the controller C1 proceeds to S221, the controller C1 determines whether a timeout has occurred. If the waiting time has not elapsed, "No" is obtained in S221, so the controller C1 returns to S206. When the waiting time has elapsed, "Yes" is obtained in S221, so the controller C1 proceeds to S222.

When the controller C1 proceeds to S222, the controller C1 assigns 1 to the variable Fin and proceeds to S231. The processing after S231 will be described later.

When the processing proceeds from S206 to S211, the controller C1 determines whether both the images formed on page 2(N+2) and page 2N−1 are monochrome images. If "Yes" is obtained in S211, the controller C1 proceeds to S214. If "No" is obtained in S211, the controller C1 proceeds to S212.

When the controller C1 proceeds to S212, the controller C1 determines whether the image forming apparatus 1 is the "2461" model.

When it is the image forming apparatus 1 (1A), "Yes" is obtained in S212, and the process returns to S201. If it is not the image forming apparatus 1 (1A), "No" is obtained in S212, and the processing proceeds to S213.

When the controller C1 proceeds to S213, the controller C1 determines whether the image formed on page 2(N+2) is a monochrome image. If "No" is obtained in S213, the controller C1 returns to S201. If "Yes" is obtained in S213, the controller C1 proceeds to S214.

The case where the "second mode: color printing process" subroutine is started in the image forming apparatus 1 (1A) and "Yes" is obtained in S211 corresponds to "a case where both the image formed on the even-number page of the sheet to be conveyed subsequent to the (N+2)th sheet and thereafter and the image formed on the odd-number page of the sheet two sheets before the sheet to be conveyed are monochrome images".

The case where the "second mode: color printing process" subroutine is started in the image forming apparatus 1 (1B) and "Yes" is obtained in S211 or "Yes" is obtained in S213 corresponds to "a case where the image formed on the even-number page of the sheet to be conveyed subsequent to the (N+2)th sheet is a monochrome image".

When the controller C1 proceeds to S214, the controller C1 assigns N+2 to the variable M and proceeds to S231. As for the (N+2)th sheet SH when "Yes" is obtained in S211 and "Yes" is obtained in S213, the sheet was scheduled to be conveyed, but is not conveyed during the current execution of the "second mode: color printing process" subroutine.

When the processing proceeds from S214 or S222 to S231, the controller C1 determines whether the image forming apparatus 1 is the "2461" model.

When it is the image forming apparatus 1 (1A), "Yes" is obtained in S231, and the processing proceeds to S232. Then, the controller C1 prints page 2N−1 in the second state, and then proceeds to S233.

If it is not the image forming apparatus 1 (1A), "No" is obtained in S231, and the processing proceeds to S233.

When the processing proceeds from S231 or S232 to S233, the controller C1 prints page 2(N+1)−1 in the second state, then ends the "second mode: color printing process" subroutine, and proceeds to S19 shown in FIG. 6.

Page 2N−1 in S232 is an example of "an odd-number page of a sheet in the middle of conveyance". Page 2(N+1)−1 in S233 is an example of "an odd-number page of a sheet in the middle of conveyance".

Returning to the duplex printing program shown in FIG. 6, when the processing proceeds from S16 or S18 to S19, the controller C1 determines whether the variable Fin is set to Fin=1. When the processing proceeds to S19 via S122 or S222, the result is "Yes", so the duplex printing program ends.

If "No" is obtained in S19, the controller C1 proceeds to S20, assigns M to the variable N, and then returns to S12. Assigning M to the variable N corresponds to "changing the sequence number of the sheet to be conveyed to the Nth sheet".

When the "third mode: odd-number side printing" subroutine shown in FIG. 12 is started, the controller C1 proceeds to S301 and, if the image formed on the odd-number page of the Nth sheet SH, that is, page 2N−1 is a color image, controls the switching mechanism 3C to switch the image forming unit 3 to the second state. If the image formed on page 2N−1 is a monochrome image, the controller C1 controls the switching mechanism 3C to switch the image forming unit 3 to the first state. When the state of the image forming unit 3 is already in the state to be switched, the controller C1 does not perform switching.

Next, the controller C1 proceeds to S302 and prints page 2N−1.

Next, the controller C1 proceeds to S303, and if the image formed on the odd-number page of the (N+1)th sheet SH, that is, page 2(N+1)−1, is a color image, the controller C1 controls the switching mechanism 3C to switch the image forming unit 3 to the second state. If the image formed on page 2(N+1)−1 is a monochrome image, the controller C1 controls the switching mechanism 3C to switch the image forming unit 3 to the first state. When the state of the image forming unit 3 is already in the state to be switched, the controller C1 does not perform switching.

Next, the controller C1 proceeds to S304, prints page 2(N+1)−1, ends the "third mode: odd-number side printing" subroutine, and proceeds to S22 shown in FIG. 6.

When the controller C1 proceeds to S22, the controller C1 assigns N+2 to the variable N and then returns to S12.

The processing of S21 and S22 shown in FIG. 6 corresponds to "when the images formed on both sides of the Nth sheet, the (N+1)th sheet, and the (N+2)th sheet are a mixture of monochrome and color images, an image is formed on both sides of the (N+1)th sheet, and then, the (N+2)th sheet is conveyed to the image forming unit to form an image thereon".

Assigning N+2 to the variable N in S22 corresponds to "changing the sequence number of the sheet to be conveyed to the Nth sheet".

Page 2N−1 in S302 and page 2(N+1)−1 in S304 shown in FIG. 12 are examples of "an odd-number page of a sheet in the middle of conveyance".

When the duplex printing program is ended and data of the odd-number page of the (N+1)th sheet SH, that is, page 2(N+1)−1 exists, page 2(N+1)−1 is printed by single-sided printing, that is, without using the reconveyance path P3.

<Operations and Effects>

When the image forming apparatus 1 (1A, 1B) of the embodiment forms an image on both sides of the sheet SH, and the image forming apparatus 1 (1A, 1B) is switched to the first state or the second state while conveying three or more sheets SH simultaneously inside the apparatus main body 2 of the image forming apparatus 1 (1A, 1B), it may be difficult to secure the time required for the switching operation performed by the switching mechanism 3C and the time for suppressing defects such as fogging after the switching operation.

In this regard, the controller C1 of the image forming apparatus 1 (1A, 1B) executes the duplex printing program shown in FIG. 6. When all the images formed on both sides of the Nth sheet, the (N+1)th sheet, and the (N+2)th sheet SH are monochrome images or color images, the controller C1 conveys the (N+2)th sheet SH to the image forming unit 3 to form an image thereon before forming an image on both sides of the (N+1)th sheet SH.

Specifically, in the "mode determination process" subroutine shown in FIG. 9, the controller C1 selects the first mode when all the images formed on both sides of the Nth sheet, the (N+1)th sheet, and the (N+2)th sheet SH are monochrome images. Then, the controller C1 proceeds to S101 shown in FIG. 10 and prints page 2(N+2). The controller C1 selects the second mode in the "mode determination process" subroutine when all the images formed on both sides of the Nth sheet, the (N+1)th sheet, and the (N+2)th sheet SH are color images. Then, the controller C1 proceeds to S201 shown in FIG. 11 and prints page 2(N+2).

As shown in FIGS. 2 and 4, in this case, three or more sheets SH are simultaneously conveyed inside the apparatus main body 2 of the image forming apparatus 1 (1A, 1B), and the state is switched to the first state or the second state depending on whether all the images are monochrome images or color images.

When the images formed on both sides of the Nth sheet, the (N+1)th sheet, and the (N+2)th sheet SH are a mixture of monochrome and color images, the controller C1 forms an image on both sides of the (N+1)th sheet SH and then conveys the (N+2)th sheet SH to the image forming unit 3 to form an image thereon.

Specifically, the controller C1 selects the third mode with some exceptions when the images formed on both sides of the Nth sheet, the (N+1)th sheet, and the (N+2)th sheet SH are a mixture of monochrome and color images in the "mode determination process" subroutine. Then, the controller C1 executes S21 and S22 shown in FIG. 6.

In this case, two or less sheets SH are simultaneously conveyed inside the apparatus main body 2 of the image forming apparatus 1 (1A, 1B), and the state is switched to the first state or the second state each time depending on whether each image is a monochrome image or a color image.

That is, as the timing of conveying the (N+2)th sheet SH, the image forming apparatus 1 (1A, 1B) selects the timing either after or before forming an image on both sides of the (N+1)th sheet SH, so that the page order of the images formed by the image forming unit 3 is changed and the first state and the second state is switched. Specifically, the image forming apparatus 1 (1A, 1B) sets the page order in which an image is formed to "page 6, page 1" or "page 1, page 6" or "page 1, page 3" as the page order subsequent to the "page 2, page 4."

As a result, the image forming apparatus 1 (1A, 1B) does not need to form an image in the second state from the beginning to the end regardless of whether the image is a monochrome image or a color image by giving priority to improving the number of sheets SH processed per unit time and does not need to convey two or less sheets SH simultaneously inside the apparatus main body 2 of the image forming apparatus 1 (1A, 1B) from the beginning to the end and switch to the first state or the second state depending on whether each image is a monochrome image or a color image by giving priority to extending the life of the development roller 7A.

Therefore, the image forming apparatus 1 (1A, 1B) of the embodiment increases the number of sheets SH processed per unit time and extends the life of the development roller 7A when forming images on both sides of the sheet SH.

The controller C1 of the image forming apparatus 1 (1A, 1B) selects the third mode in the "mode determination process" subroutine shown in FIG. 9, and executes the "third mode: odd-number side printing" subroutine shown in FIG. 12 to form images in the order of the even-number page of the Nth sheet SH, the even-number page of the (N+1)th sheet SH, the odd-number page of the Nth sheet SH, and the odd-number page of the (N+1)th sheet SH. After that, the controller C1 proceeds to S22 shown in FIG. 6, changes the order number of the (N+2)th sheet SH to the Nth sheet, and conveys the Nth sheet SH.

With this configuration, it is possible to switch between the first state and the second state by selecting the timing after forming images on both sides of the (N+1)th sheet SH as the timing of conveying the (N+2)th sheet SH. As a result, the page order of the images formed by the image forming unit 3 is changed so that the "2413" control is executed. Then, by changing the sequence number of the sheet SH after the execution, images are continuously formed for the remaining sheets SH.

The controller C1 of the image forming apparatus 1 (1A, 1B) selects the first mode in the "mode determination process" subroutine shown in FIG. 9, and when "No" is obtained in S111, executes S112 to S133 and further executes S20 shown in FIG. 6 during execution of the "first mode: monochrome printing process" subroutine shown in FIG. 10. As a result, the sheet SH scheduled to be conveyed is not conveyed, an image is formed on the odd-number page of the sheet SH in a middle of conveyance, and then the sequence number of the sheet SH scheduled to be conveyed is changed to the Nth sheet, and the Nth sheet SH is conveyed.

With this configuration, when a series of monochrome images ends, the state is switched between the first state and the second state by changing the order in which images are formed on the sheet SH scheduled to be conveyed and the sheet SH in a middle of conveyance.

The controller C1 of the image forming apparatus 1 (1A) of the "2461" model selects the second mode and executes "second mode: color printing process" subroutine shown in FIG. 11 when "Yes" is obtained in S83 of the "mode determination process" subroutine shown in FIG. 9, "Yes" is obtained in S84, and "No" is obtained in S85. As a result, in a state in which the image forming unit 3 remains in the second state, after images are formed in the order of the even-number page of the Nth sheet SH and the even-number page of the (N+1)th sheet SH, the (N+2)th sheet SH is conveyed to form an image thereon, and then an image is formed on the odd-number page of the Nth sheet SH.

With this configuration, the timing before an image is formed on both sides of the (N+1)th sheet SH is selected as the timing of conveying the (N+2)th sheet SH, and the image forming unit 3 forms an image by the "2461" control in the second state, whereby the number of sheets SH processed per unit time is increased. For monochrome pages, too, an image is formed in a state where the image forming unit 3 is in the second state.

When "Yes" is obtained in S211 during the execution of the "second mode: color printing process" subroutine shown in FIG. 11, the controller C1 of the image forming apparatus 1 (1A) executes S214 to S233 and further executes S20 shown in FIG. 6. As a result, the sheet SH scheduled to be conveyed is not conveyed, an image is formed on the odd-number page of the sheet SH in a middle of conveyance, and then the sequence number of the sheet SH scheduled to be conveyed is changed to the Nth sheet, and the Nth sheet SH is conveyed.

With this configuration, when a monochrome image is mixed in a series of color images under a particular condition, the first state and the second state are switched by changing the order in which images are formed on the sheet SH to be conveyed and the sheet SH in a middle of conveyance. When the image formed on the odd-number page of the sheet SH in a middle of conveyance is a monochrome image, too, the image is formed in a state where the image forming unit 3 remains in the second state.

The controller C1 of the image forming apparatus 1 (1B) of the "2416" model selects the second mode and executes the "second mode: color printing process" subroutine shown in FIG. 11 when "Yes" is obtained in S83 of the "mode determination process" subroutine shown in FIG. 9, "No" is obtained in S84, and "Yes" is obtained in S87. As a result, in a state in which the image forming unit 3 remains in the second state, images are formed in the order of the even-number page of the Nth sheet, the even-number page of the (N+1)th sheet, and the odd-number page of the Nth sheet, and thereafter the (N+2)th sheet is conveyed to form an image thereon.

With this configuration, the timing before the image is formed on both sides of the (N+1)th sheet SH is selected as the timing of conveying the (N+2)th sheet SH, and the image forming unit 3 forms an image by the "2416" control in the second state, whereby the number of sheets SH processed per unit time is increased. For monochrome pages, too, an image is formed in a state where the image forming unit 3 remains in the second state.

The case where the controller C1 of the image forming apparatus 1 (1B) obtains "Yes" in S83 of the "mode determination process" subroutine shown in FIG. 9, "No" in S84, and "Yes" in S87 includes a case where the odd-number page of the (N+1)th sheet SH is monochrome. In this case, too, the controller C1 forms an image on the (N+2)th sheet SH and then forms an image on the odd-number page of the (N+1)th sheet SH in a state where the image forming unit 3 remains in the second state.

With this configuration, even if the odd-number page of the (N+1)th sheet SH is monochrome, the "2416" control is executed in the second state, so that the number of sheets SH processed per unit time is further increased.

When "Yes" is obtained in S211 or "Yes" is obtained in S213 during the execution of the "second mode: color printing process" subroutine shown in FIG. 11, the controller C1 of the image forming apparatus 1 (1B) executes S214 to S233 and further executes S20 shown in FIG. 6. As a result, the sheet SH scheduled to be conveyed is not conveyed, an image is formed on the odd-number page of the sheet SH in a middle of conveyance, and then the sequence number of the sheet SH scheduled to be conveyed is changed to the Nth sheet, and the Nth sheet SH is conveyed.

With this configuration, when a monochrome image is mixed in a series of color images under a particular condition, the first state and the second state are switched by changing the order in which images are formed on the sheet SH scheduled to be conveyed and the sheet SH in a middle of conveyance. When the image formed on the odd-number page of the sheet SH in a middle of conveyance is a monochrome image, too, the image is formed in a state where the image forming unit 3 remains in the second state.

While the disclosure has been described in detail with reference to the above aspects thereof, it would be apparent to those skilled in the art that various changes and modifications may be made therein without departing from the scope of the claims.

In the mode determination process shown in FIG. 9, in a case where the images to be formed on both sides of each of the Nth sheet, the (N+1)th sheet, and the (N+2)th sheet are a mixture of the monochrome image and the color image and where a first condition (S83: No, S85: Yes, S87: No) is satisfied, the controller C1 selects the third mode. In a case where the images to be formed on both sides of each of the Nth sheet, the (N+1)th sheet, and the (N+2)th sheet are a mixture of the monochrome image and the color image and where a second condition (S85: No, S87: Yes) different from the first condition is satisfied, the controller C1 selects the second mode. Alternatively, in a case where the images to be formed on both sides of each of the Nth sheet, the (N+1)th sheet, and the (N+2)th sheet are a mixture of the monochrome image and the color image, the controller C1 may always select the third mode. In this case, after determination of S81: No, the controller C1 determines whether all the images formed on both sides of the Nth sheet, the (N+1)th sheet, and the (N+2)th sheet SH are color images, that is, whether all the images formed on page 2N, page 2(N+1), page 2(N+2), page 2N−1, page 2(N+1)−1, and page 2(N+2)−1 are color images. In this determination, if "Yes" is obtained, the controller C1 selects the second mode and, if "No" is obtained, the controller C1 selects the third mode.

For example, determination of whether the image forming apparatus 1 is the "2461" model in steps S53, S84, S102, S131, S202, and S231 may be omitted. For example, for an apparatus for which it is set preliminarily whether it is a 2461 model, a duplex printing program may be set according to the apparatus. That is, in the case of the "2461" model apparatus, the processing of steps S53, S71 to S77, S84, S87, S102, S104, S131, S201, S204 and S231 may be deleted from the duplex printing program of the embodiment. Similarly, in the case of the "2416 model" apparatus, the processes of steps S53 to S55, S61 to S65, S84 to S86, S102, S103, S131, S132, S202, S203, S231 and S232 may be deleted from the duplex printing program of the embodiment. Alternatively, both a duplex printing program dedicated to the "2461" model and a duplex printing program dedicated to the "2416" model may be stored preliminarily, and which program to execute may be determined at the start of duplex printing.

In the embodiment, the controller C1 executes the mode determination process shown in FIG. 9 at the timing of step S14, that is, at the timing when printing up to the 2(N+1)th page is completed. Alternatively, the mode determination process may be executed at the time when duplex printing is started, that is, before the operation of step S12, for example. However, by executing the mode determination process in step S14 after printing up to the 2Nth page and the 2(N+1)th page is completed, images can be formed first on the 2Nth page and the 2(N+1)th page without data for forming an image on the (N+2)th sheet SH, which shortens the time required for image formation.

The waiting time in steps S44, S55, S74, S121, and S221 may all be the same, all may be different, or some may be the same and some may be different.

This disclosure may be applied to an image forming apparatus or a multifunction peripheral, for example.

What is claimed is:

1. An image forming apparatus comprising:

a print engine including a plurality of sets of a development roller and a photosensitive drum configured to contact and separate from the development roller, the print engine being configured to form an image on a sheet, the print engine being configured to switch between:

a first state in which one of the plurality of sets of the development roller and the photosensitive drum contact each other and an other one of the plurality of sets of the development roller and the photosensitive drum separate from each other for forming a monochrome image; and a second state in which all of the plurality of sets of the development roller and the photosensitive drum contact each other for forming a color image;

a conveyor configured to convey the sheet to the print engine and thereafter reverse a conveyance direction of the sheet and reconvey the sheet to the print engine; and a controller configured to control the print engine and the conveyor to form an image on both sides of the sheet, the controller being configured to:

in a case where images to be formed on both sides of each of an Nth (N is a positive integer) sheet, an (N+1)th sheet, and an (N+2)th sheet are all the monochrome image or all the color image, convey the (N+2)th sheet to the print engine and form an image before forming an image on both sides of the (N+1)th sheet; and in a case where the images to be formed on both sides of each of the Nth sheet, the (N+1)th sheet, and the (N+2)th sheet are a mixture of the monochrome image and the color image, convey the (N+2)th sheet to the print engine and form an image after forming an image on both sides of the (N+1)th sheet.

2. The image forming apparatus according to claim 1, wherein the controller is configured to:

in a case where the images to be formed on both sides of each of the Nth sheet, the (N+1)th sheet, and the (N+2)th sheet is a mixture of the monochrome image and the color image, form an image on an even-number page of the Nth sheet, an even-number page of the (N+1)th sheet, an odd-number page of the Nth sheet, and an odd-number page of the (N+1)th sheet in this order, and thereafter change a sequence number of the (N+2)th sheet to the Nth sheet and convey the Nth sheet.

3. The image forming apparatus according to claim 2, wherein the controller is configured to:

in a case where the images to be formed on both sides of each of the Nth sheet, the (N+1)th sheet, and the (N+2)th sheet are all the monochrome image and at least one of images of both sides of a sheet scheduled to be conveyed subsequent to the (N+2)th sheet is not the monochrome image, without conveying the sheet scheduled to be conveyed, form an image on an odd-number page of a sheet in a middle of conveyance, and thereafter change a sequence number of the sheet scheduled to be conveyed to the Nth sheet and convey the Nth sheet.

4. The image forming apparatus according to claim 1, wherein the controller is configured to control the conveyor to convey four or more sheets simultaneously inside the image forming apparatus; and wherein the controller is configured to:

in a case where images of even-number pages of both the Nth sheet and the (N+1)th sheet are the color image and at least an image of an even-number page of the (N+2)th sheet or an image of an odd-number page of the Nth sheet is not the monochrome image, form an image on an even-number page of the Nth sheet and an image of an even-number page of the (N+1)th sheet in this order, and thereafter convey the (N+2)th sheet and form an image thereon, and thereafter form an image on an odd-number page of the Nth sheet in a state where the print engine is kept in the second state.

5. The image forming apparatus according to claim 4, wherein the controller is configured to:

in a case where an image of an even-number page of a sheet scheduled to be conveyed subsequent to the (N+2)th sheet is the monochrome image and an image of an odd-number page formed on a sheet that is two sheets before the sheet scheduled to be conveyed is also the monochrome image, without conveying the sheet scheduled to be conveyed, form an image on an odd-number page of a sheet in a middle of conveyance in a state where the print engine is kept in the second state, and thereafter change a sequence number of the sheet scheduled to be conveyed to the Nth sheet and convey the Nth sheet.

6. The image forming apparatus according to claim 1, wherein the controller is configured to control the conveyor to convey three sheets simultaneously inside the image forming apparatus; and wherein the controller is configured to:

in a case where images of even-number pages of the Nth sheet and the (N+1)th sheet are both the color image and an image of an odd-number page of the Nth sheet and an image of an even-number page of the (N+2)th sheet are both the color image, form images on an even-number page of the Nth sheet, an even-number page of the (N+1)th sheet, and an odd-number page of the Nth sheet in this order and thereafter convey the (N+2)th sheet and form an image thereon in a state where the print engine is kept in the second state.

7. The image forming apparatus according to claim 6, wherein the controller is configured to:

in a case where an odd-number page of the (N+1)th sheet is the monochrome image, form an image on the (N+2)th sheet and thereafter form an image on the odd-number page of the (N+1)th sheet in a state where the print engine is kept in the second state.

8. The image forming apparatus according to claim 6, wherein the controller is configured to:

in a case where an image of an even-number page of a sheet scheduled to be conveyed subsequent to the (N+2)th sheet is the monochrome image, without conveying the sheet scheduled to be conveyed, form an image on an odd-number page of a sheet in a middle of conveyance in a state where the print engine is kept in the second state, and thereafter change a sequence number of the sheet scheduled to be conveyed to the Nth sheet and convey the Nth sheet.

9. The image forming apparatus according to claim 1, wherein the controller is configured to:

in a case where the images to be formed on both sides of each of the Nth sheet, the (N+1)th sheet, and the (N+2)th sheet are a mixture of the monochrome image and the color image and where a first condition is satisfied, convey the (N+2)th sheet to the print engine and form an image after forming an image on both sides of the (N+1)th sheet; and in a case where the images to be formed on both sides of each of the Nth sheet, the (N+1)th sheet, and the (N+2)th sheet are a mixture of the monochrome image and the color image and where a second condition different from the first condition is satisfied, convey the (N+2)th sheet to the print engine and form an image before forming an image on both sides of the (N+1)th sheet.

10. The image forming apparatus according to claim 1, wherein the controller is configured to:

determine whether the image forming apparatus is a first conveyance type configured to convey four or more sheets simultaneously inside the image forming apparatus and form an image on both sides of the sheets or a second conveyance type configured to convey three sheets simultaneously inside the image forming apparatus and form an image on both sides of the sheets;

in a case where the image forming apparatus is the first conveyance type and the images to be formed on both sides of each of the Nth sheet, the (N+1)th sheet, and the (N+2)th sheet are all the monochrome image or all the color image, convey the sheets to the print engine and form an image in an order of an even-number page of the Nth sheet, an even-number page of the (N+1)th sheet, an even-number page of the (N+2)th sheet, and an odd-number page of the Nth sheet;

in a case where the image forming apparatus is the second conveyance type and the images to be formed on both sides of each of the Nth sheet, the (N+1)th sheet, and the (N+2)th sheet are all the monochrome image or all the color image, convey the sheets to the print engine and form an image in an order of the even-number page of the Nth sheet, the even-number page of the (N+1)th sheet, the odd-number page of the Nth sheet, and the even-number page of the (N+2)th sheet; and in a case where the images to be formed on both sides of each of the Nth sheet, the (N+1)th sheet, and the (N+2)th sheet are a mixture of the monochrome image and the color image, regardless of whether the image forming apparatus is the first conveyance type or the second conveyance type, convey the sheets to the print engine and form an image in an order of the even-number page of the Nth sheet, the even-number page of the (N+1)th sheet, the odd-number page of the Nth sheet, and the odd-number page of the (N+1)th sheet.

11. An image forming apparatus comprising:

a print engine including a plurality of sets of a development roller and a photosensitive drum, the print engine being configured to form an image on a sheet;

a plurality of rollers configured to convey the sheet to the print engine and thereafter reverse a conveyance direction of the sheet and reconvey the sheet to the print engine; and a controller configured to control the print engine and the plurality of rollers to form an image on both sides of the sheet, the controller being configured to:

in a case where images to be formed on both sides of each of an Nth (N is a positive integer) sheet, an (N+1)th sheet, and an (N+2)th sheet are all a monochrome image or all a color image, convey the (N+2)th sheet to the print engine and form an image before forming an image on both sides of the (N+1)th sheet; and in a case where the images to be formed on both sides of each of the Nth sheet, the (N+1)th sheet, and the (N+2)th sheet are a mixture of the monochrome image and the color image, convey the (N+2)th sheet to the print engine and form an image after forming an image on both sides of the (N+1)th sheet.

* * * * *